United States Patent [19]

Guanella et al.

[11] 4,160,123

[45] Jul. 3, 1979

[54] METHODS OF AND APPARATUS FOR THE ENCODED TRANSMISSION OF INFORMATION

[75] Inventors: Gustav Guanella, Zurich; Alban Graf, Gebenstorf, both of Switzerland

[73] Assignee: Patelhold Patentverwertungs- & Elektro-Holding AG, Glarus, Switzerland

[21] Appl. No.: 654,373

[22] Filed: Feb. 2, 1976

[30] Foreign Application Priority Data

Feb. 26, 1975 [CH] Switzerland ..... 2432/75

[51] Int. Cl.[2] ..... H04K 1/06

[52] U.S. Cl. ..... 179/1.5 R; 178/22

[58] Field of Search ..... 178/22; 179/1.5 R

[56] References Cited

U.S. PATENT DOCUMENTS

| | | | |
|---|---|---|---|
| 3,657,699 | 4/1972 | Rocher | 178/22 |
| 3,731,197 | 5/1973 | Clark | 178/22 |
| 3,773,977 | 11/1973 | Guanella | 178/22 |
| 3,824,467 | 7/1974 | French | 178/22 |
| 3,921,151 | 11/1975 | Guanella | 178/22 |
| 3,970,790 | 7/1976 | Guanella | 178/22 |

*Primary Examiner*—Howard A. Birmiel

*Attorney, Agent, or Firm*—Orville N. Greene; Frank L. Durr

[57] ABSTRACT

Method and apparatus for encoding transmitted data and decoding the data at a receiving facility. The data is divided into elements of equal length. Each element is assigned an age number having a value within a prescribed range. The age value determines the number of delay intervals experienced by each element before being transmitted. Delays of the proper length are obtained by the use of storage elements. Age numbers are assigned arbitrarily. The age numbers are incremented upon the passage of each delay interval. Values within the aforementioned range are randomly generated. A data element is removed from storage and transmitted when: (1) its age number compares with the randomly generated value; or (2) when its age number reaches the extreme value; or (3) when its age number is zero. A new element is placed in storage simultaneously with the removal of an element therefrom.

At the receiver end elements are stored and their age numbers are incremented upon the occurrence of each delay interval. Elements are removed from storage (and replaced by a newly received element) when they reach the extreme value. Elements having age numbers of zero (i.e. "no delay") are transferred to the receiver output line without delay. The re-transposed elements at the receiver output line reconstruct the message elements into the arrangement of the original data as it was before its encoding (i.e. transposition) at the transmitting end. Various modifications of the basic technique are provided to encode various types of data and to solve other technical problems.

54 Claims, 43 Drawing Figures

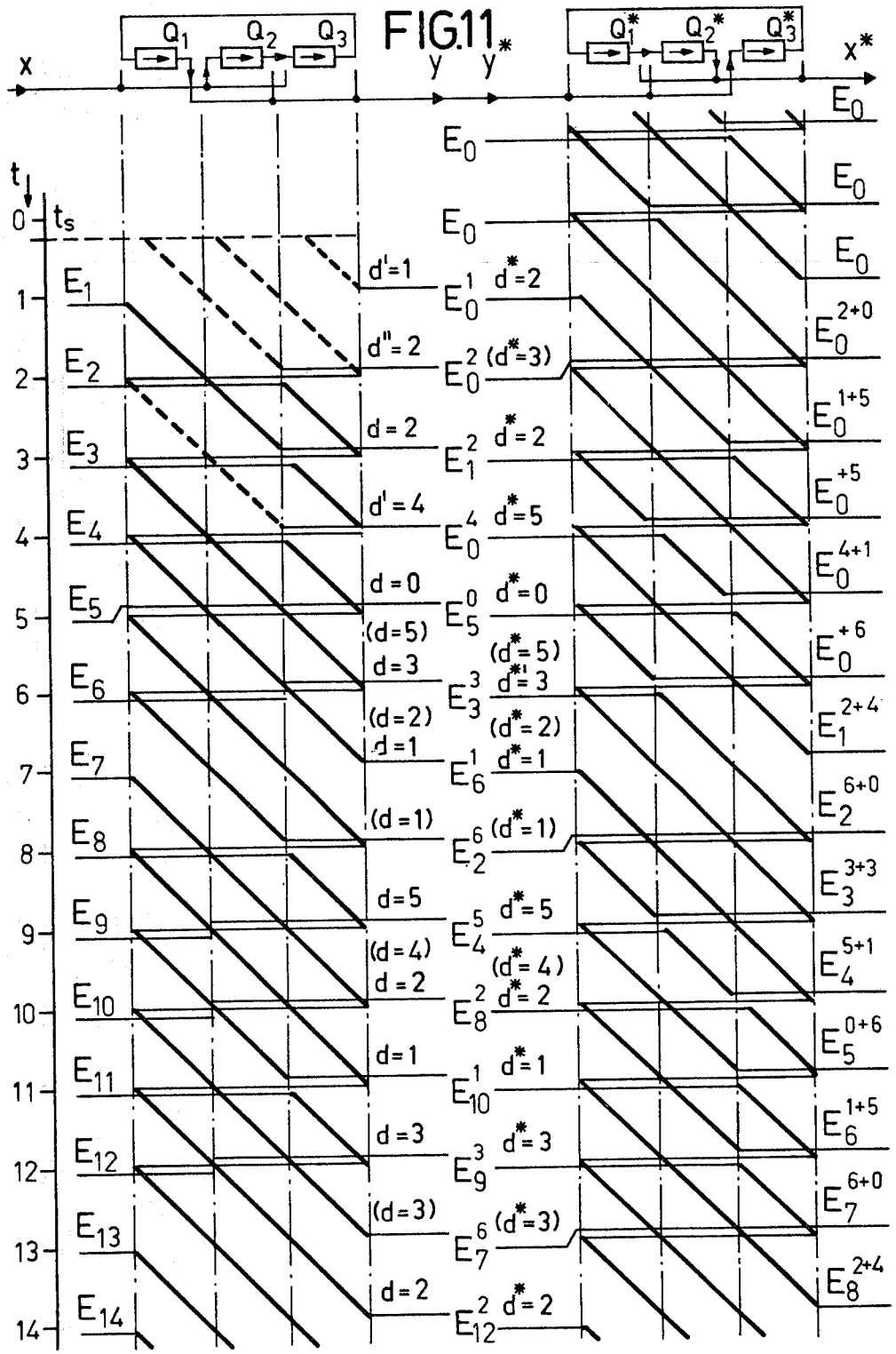
FIG.11
x
y
y*
x*
t
$t_s$
$Q_1$ $Q_2$ $Q_3$
$Q_1^*$ $Q_2^*$ $Q_3^*$
0
1
2
3
4
5
6
7
8
9
10
11
12
13
14
$E_1$ $E_2$ $E_3$ $E_4$ $E_5$ $E_6$ $E_7$ $E_8$ $E_9$ $E_{10}$ $E_{11}$ $E_{12}$ $E_{13}$ $E_{14}$
d'=1
d''=2
d=2
d'=4
d=0
(d=5)
d=3
(d=2)
d=1
(d=1)
d=5
(d=4)
d=2
d=1
d=3
(d=3)
d=2
$E_0$
$E_0$
$E_0$
$E_0^1$ $d^*=2$
$E_0^2$ $(d^*=3)$
$E_1^2$ $d^*=2$
$E_0^4$ $d^*=5$
$E_5^0$ $d^*=0$
$(d^*=5)$
$E_3^3$ $d^*=3$
$(d^*=2)$
$E_6^1$ $d^*=1$
$E_2^6$ $(d^*=1)$
$E_4^5$ $d^*=5$
$(d^*=4)$
$E_8^2$ $d^*=2$
$E_{10}^1$ $d^*=1$
$E_9^3$ $d^*=3$
$E_7^6$ $(d^*=3)$
$E_{12}^2$ $d^*=2$
$E_0$
$E_0$
$E_0$
$E_0^{2+0}$
$E_0^{1+5}$
$E_0^{+5}$
$E_0^{4+1}$
$E_0^{+6}$
$E_1^{2+4}$
$E_2^{6+0}$
$E_3^{3+3}$
$E_4^{5+1}$
$E_5^{0+6}$
$E_6^{1+5}$
$E_7^{6+0}$
$E_8^{2+4}$ R1
R2
R3
U0
U1
U2
U3
VE
x, y*
y, x*
i0
i1
i2
i3
AP
FIXED STORE
FS1
0 0 0
A
B
g1
UV0
UV1
UV2
UV3
e05
P0
P1
P2
P3
k*
V0
RW1
P30
P31
P32
P33
T3
GATE
e3
SR3
SHIFT REGISTER
k
SHIFT REGISTER
Sm
z0
e21
P21
P22
P27
P28
SU
ADDER
SR21
e2
z
SR2
e
DELAY
kGATE
k
TV2
FIXED STORE
T2
KO
1 1 0
e31
FS2
RW2
g2
B
A
dB
e01
SHIFT REGISTER
STORE
RS
P11
P16
CW2
e012
d
+
e1
SR1
S
b
d
e1
DELAY
TV1
C
e011
a'
AK FIG. 32.
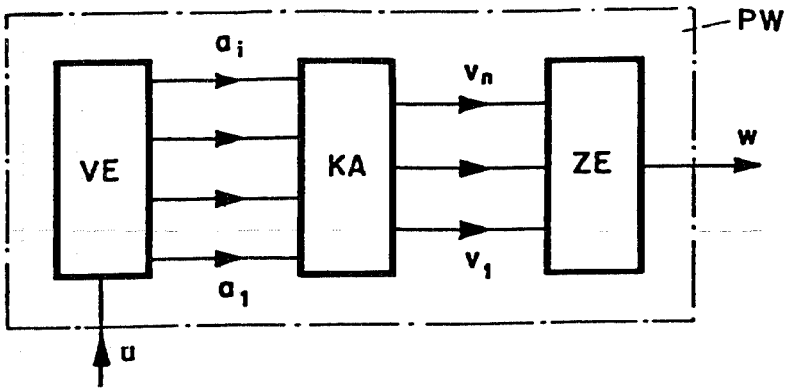
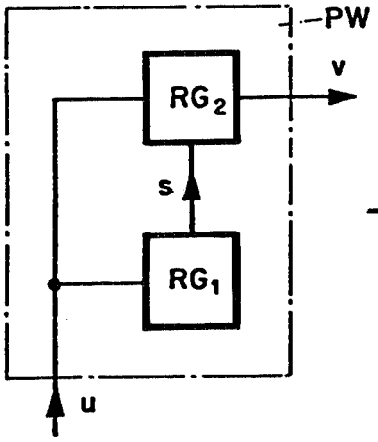
FIG. 33.
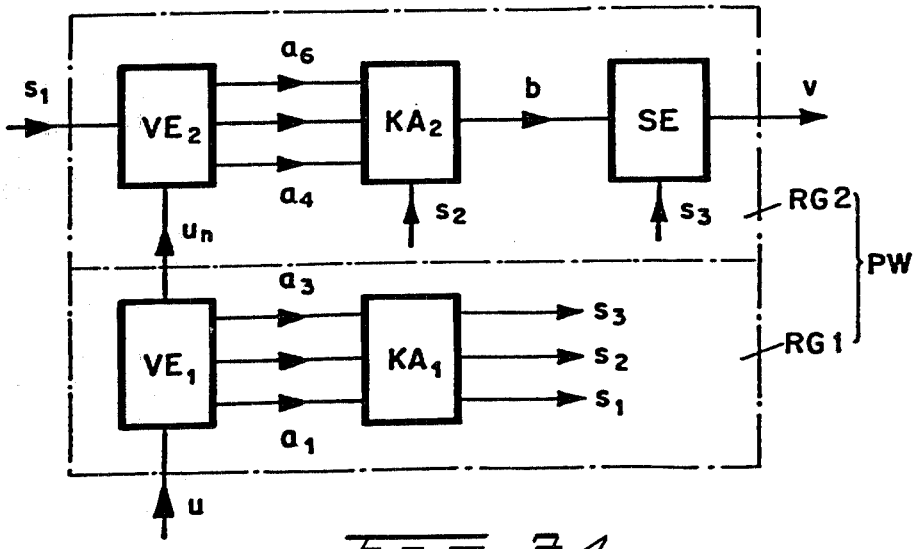
FIG. 34.

| a1 | a2 | A | B | C | D | E |
|---|---|---|---|---|---|---|
| + | + | + | + | + | + | + |
| + | 0 | 0 | + | 0 | + | M |
| + | − | − | 0 | 0 | M | M |
| 0 | + | 0 | + | 0 | + | M |
| 0 | 0 | 0 | 0 | 0 | M | M |
| 0 | − | 0 | − | 0 | − | M |
| − | + | − | 0 | 0 | M | M |
| − | 0 | 0 | − | 0 | − | M |
| − | − | + | − | − | − | − |

METHODS OF AND APPARATUS FOR THE ENCODED TRANSMISSION OF INFORMATION

BACKGROUND OF THE INVENTION

This invention concerns methods of and apparatus for the encoded transmissions of information in which message elements of equal length are interchanged in time at the transmitter by storage and delay and are re-interchanged at the receiver. In known methods of this kind the storage times are chosen so that no element of the original message (clear message) is omitted from the encoded message and also so that no two or more elements appear simultaneously.

In accordance with a known proposal in British Patent No. 1,353693 several stores are employed, the capacity of each corresponding to one message element. At equal time intervals, corresponding to the length of one message element, there is determined by a quasi-random control signal the number of that one of the stores from which an element of the encoded message is to be withdrawn and into which at the same time an element of the clear message is to introduced. In this method excessive storage times can be avoided by automatic withdrawal of a message element from any store when a predetermined maximum storage time has been reached. In this method of coding, the delay times of the message elements are not uniformly distributed: the probability decreases with increasing delay, while the extreme delay does not appear very frequently. It is true that a certain equalisation of this cryptologically undesirable distribution is possible by operating the individual storeswith unequal maximum delay times. The cost of carrying out this operation automatically is however considerable and in addition it is undesirable for reasons of cryptological security that the storage times shall be determined to an increased extent by the individual storage capacity and not in the first place by the quasi-random control signal.

According to other proposals, given British Patent No. 1,356,970, the message elements are stored in shifting registers, in which the input and withdrawal locations are determined by quasi-random control signals. After the withdrawal of an element the respective storage location thus remains temporarily empty. This leads to inefficient utilization of the available storage capacity and thus to relatively high cost.

BRIEF DESCRIPTION OF THE INVENTION

According to the present invention, disadvantages of known proposals are reduced or overcome by the provision of a method for the encoded transmission of data, in which data elements of equal length are, by storage and delay for different times, interchanged in timing at the transmitting station and are re-interchanged at the receiving station, wherein there is allotted to each element introduced into a store for delay an age number which, after the lapse of each one element length of storage time at the two stations, is altered in the corresponding sense by one step; there are generated at both stations corresponding age signals changing irregularly within certain limits; at one station the age number allotted to an applied element has at first a definite first extreme value and alters stepwise until it corresponds with a simultaneously appearing age signal, whereupon the element is withdrawn from the store and is replaced in the store by a new element of the input signal; at the other station the age number allotted to a newly applied element is as large as the age signal appearing at the same instant; it is thereafter altered stepwise in the same sense as at the one station until it corresponds with a second extreme value, whereupon the element is withdrawn from the store and is replaced in the store by a new element of the input signal.

The invention also provides apparatus for encoded transmission of data including means whereby data elements of equal length are, by storage and delay for different times, interchanged in time at a transmitting station and are re-interchanged at a receiving station, said apparatus including an age generator for generating a series of quasi-random varying age signals which determine the storage times of individual elements, and age/location converter wherein there are derived from the age signals store control signals which actuate change-over switches, by way of which the individual data elements are applied to or withdrawn from the stores of a delay device.

It is thus possible for the clear message to comprise a train of impulses, as is the case in the transmission of digital data; however it is also possible to transmit an analog signal (e.g. an audio signal) or a train of impulses of changing amplitude (e.g. sampling values of an audio signal). For simpler storage the latter may advantageously be replaced by a corresponding train of digital impulses derived by binary coding or by some other method of coding. The elements to be interchanged to produce the coded signal consist of sections of the clear signal of predetermined length; that is, they comprise one or more amplitude modulated impulses or one or more bits of a train of digital impulses.

BRIEF DESCRIPTION OF THE FIGURES

Reference will now be made to the drawings in order to describe known arrangements and characteristics of the invention, as well as some embodiments and details of the invention. The drawings comprise FIGS. 1–29, of which.

Figure 4:
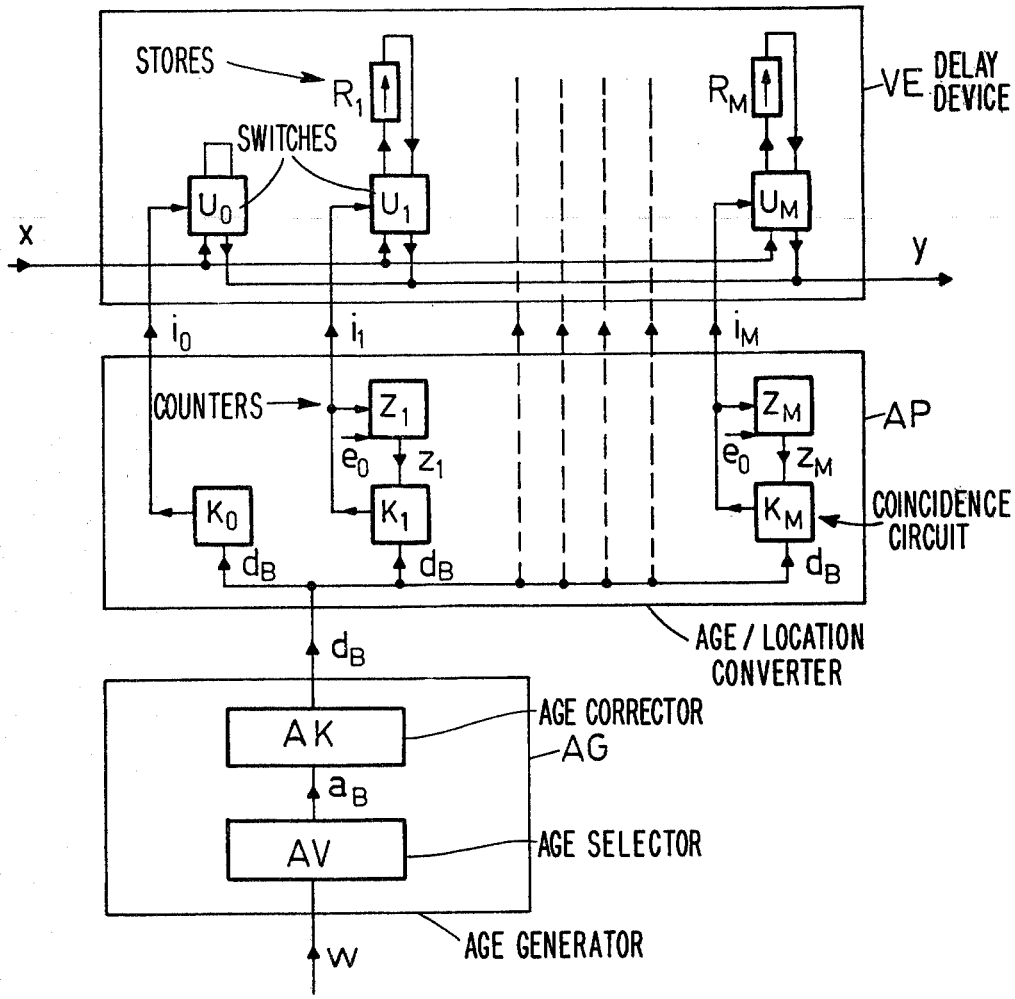
FIGS. 4 and 5 are block diagrams which illustrate the transmitter and receiver age/position converters respectively.
Figure 6:
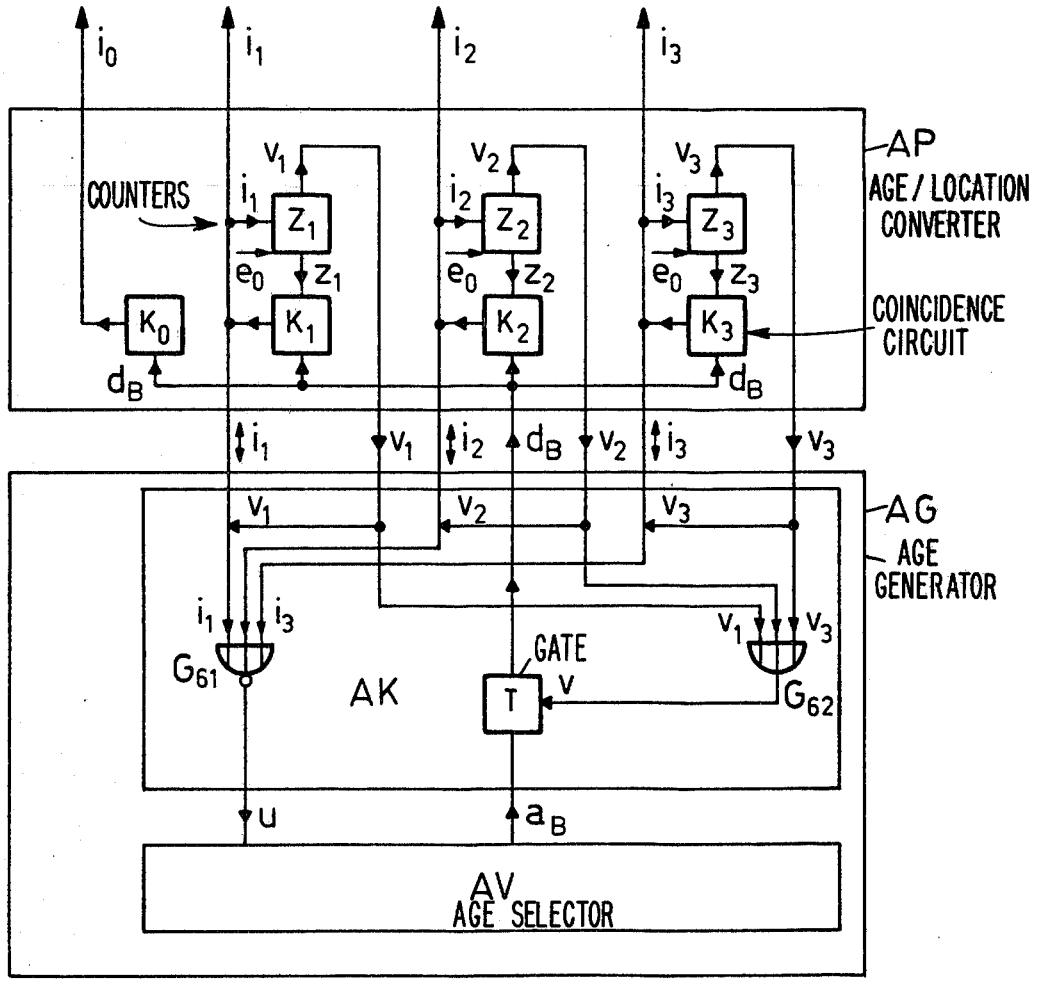
Figure 7:
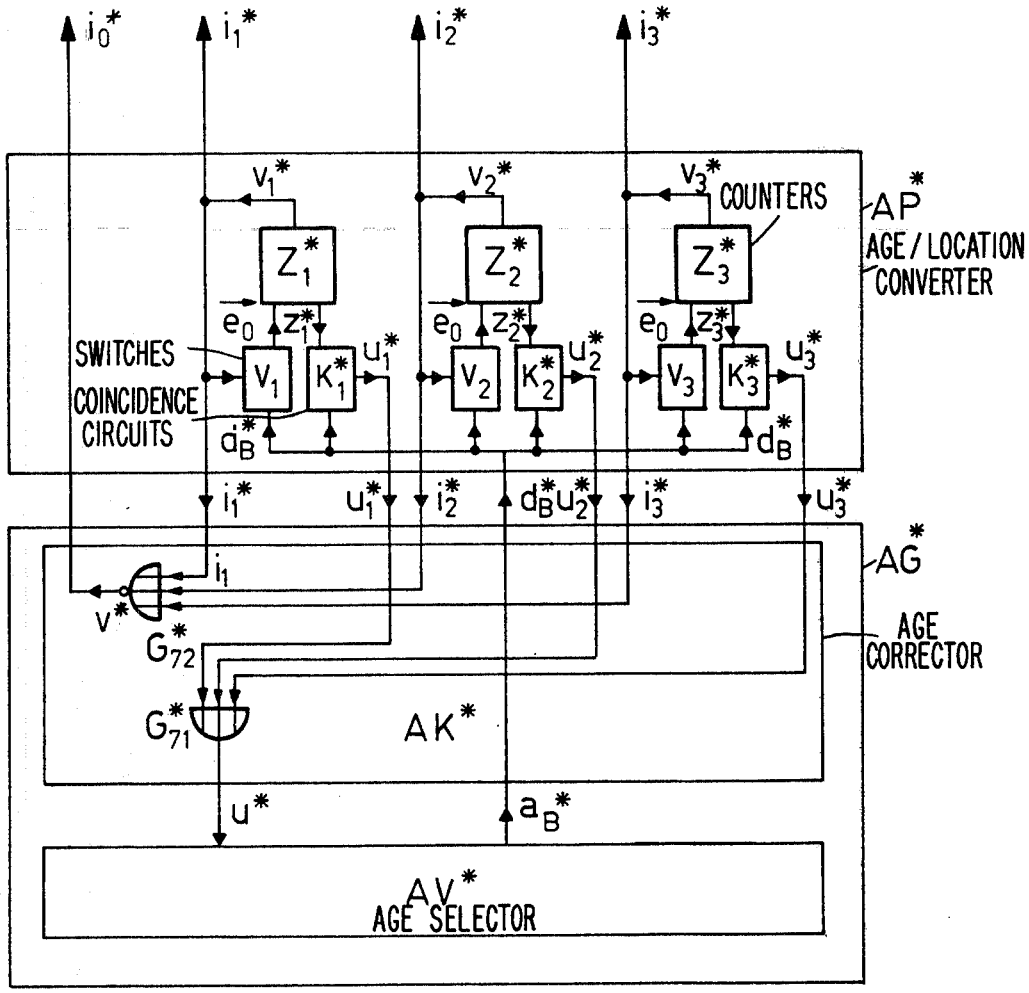
Figure 8:
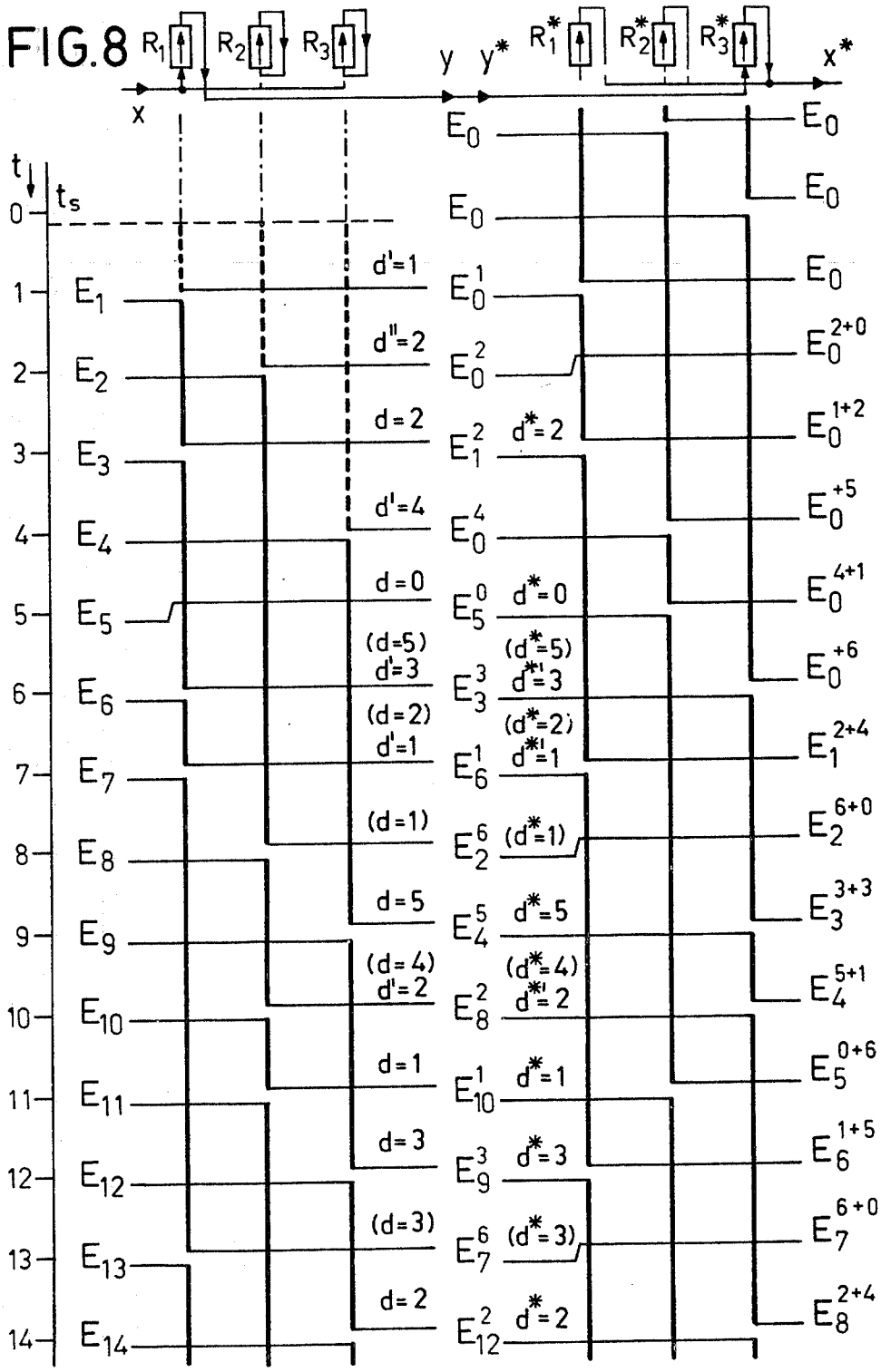
Figure 9:
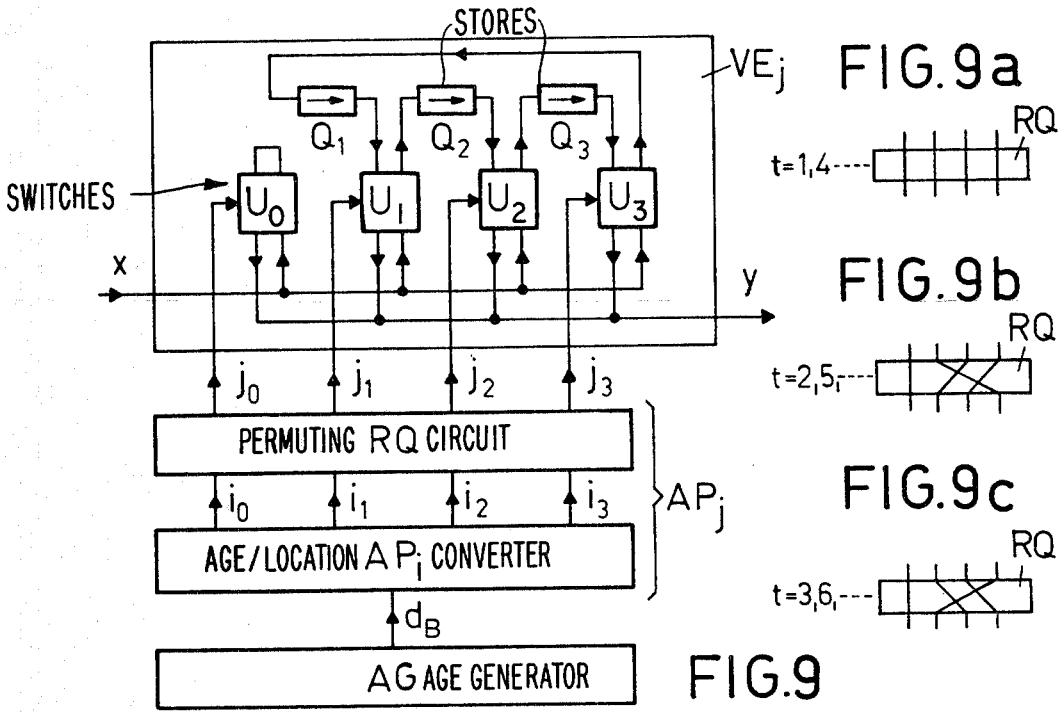
Figure 10:
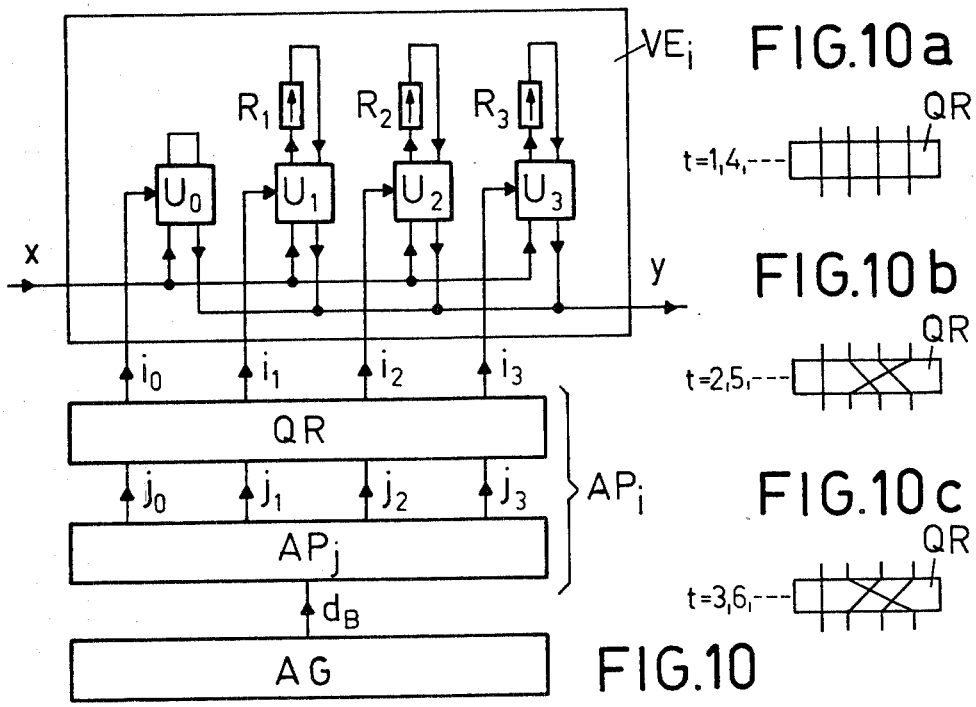
Figure 12:
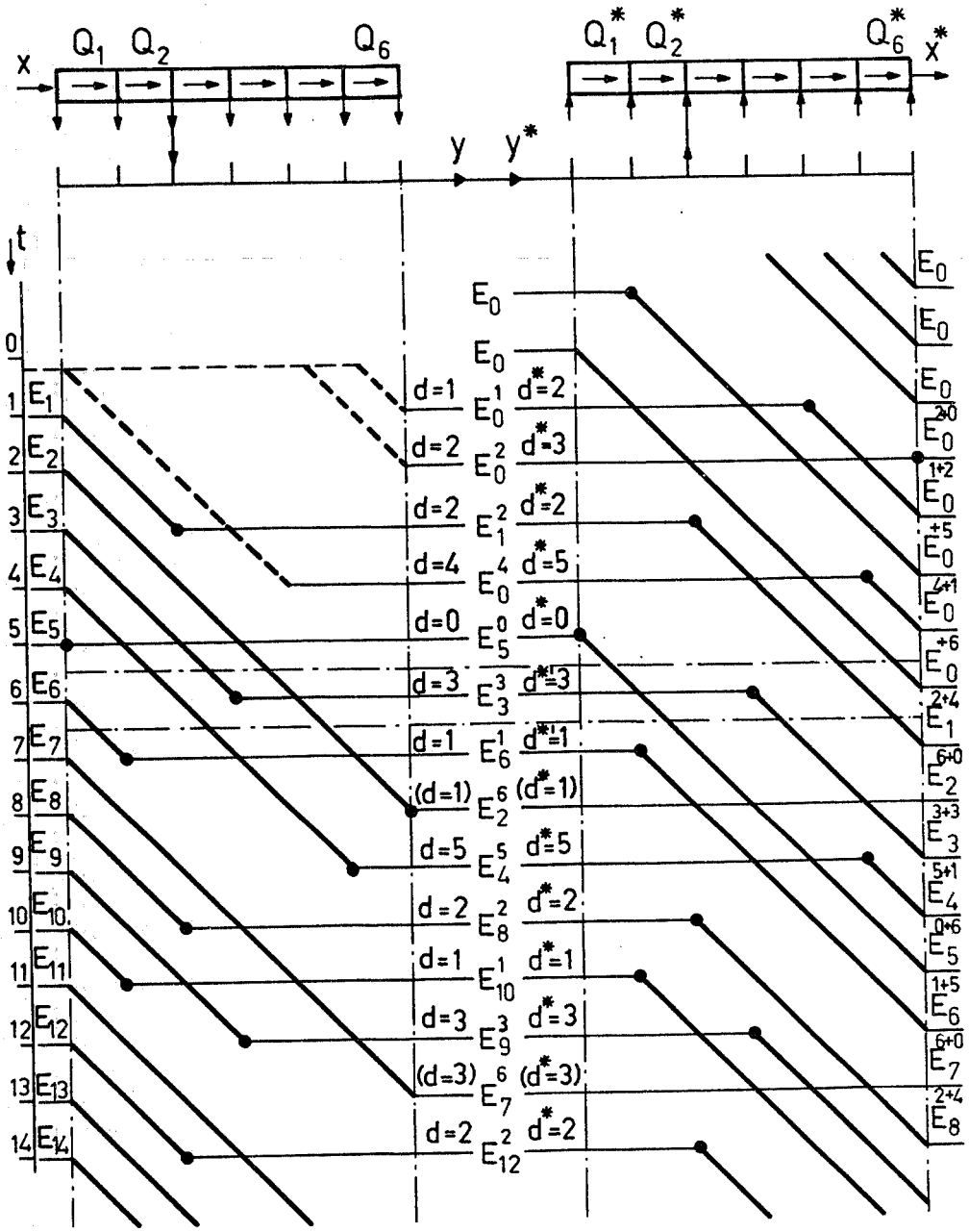
Figure 17:
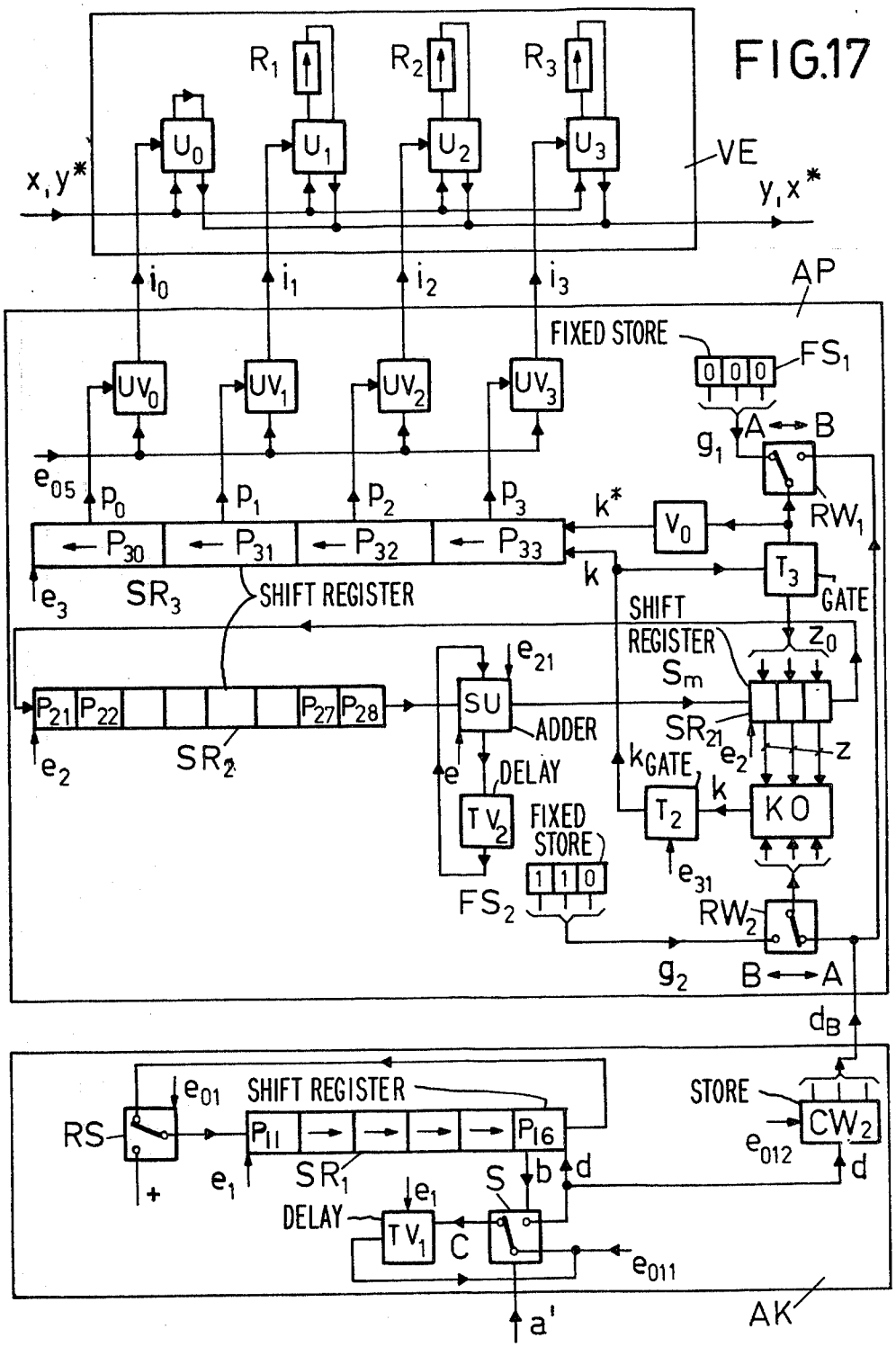
Figure 18:
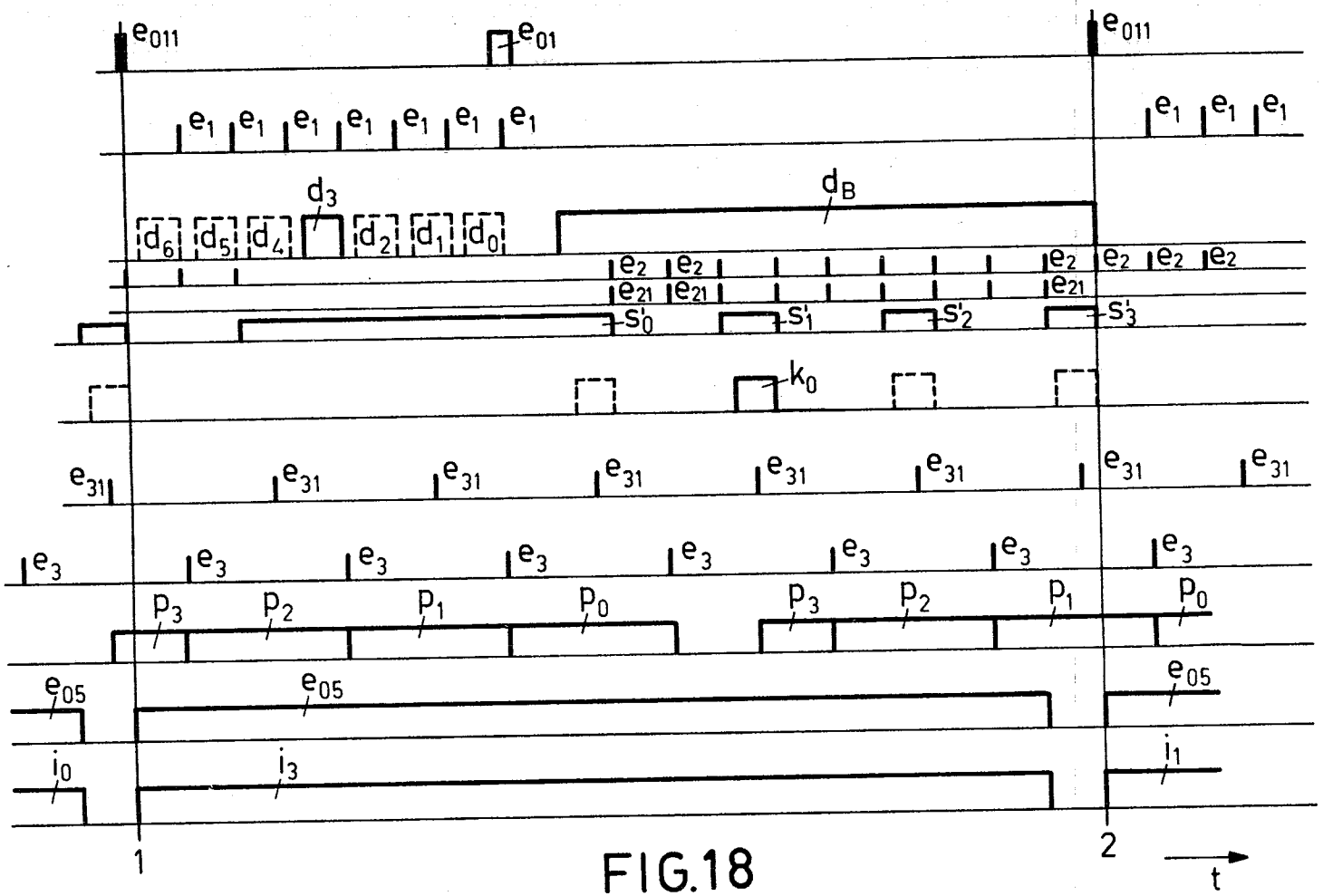
Figure 19:
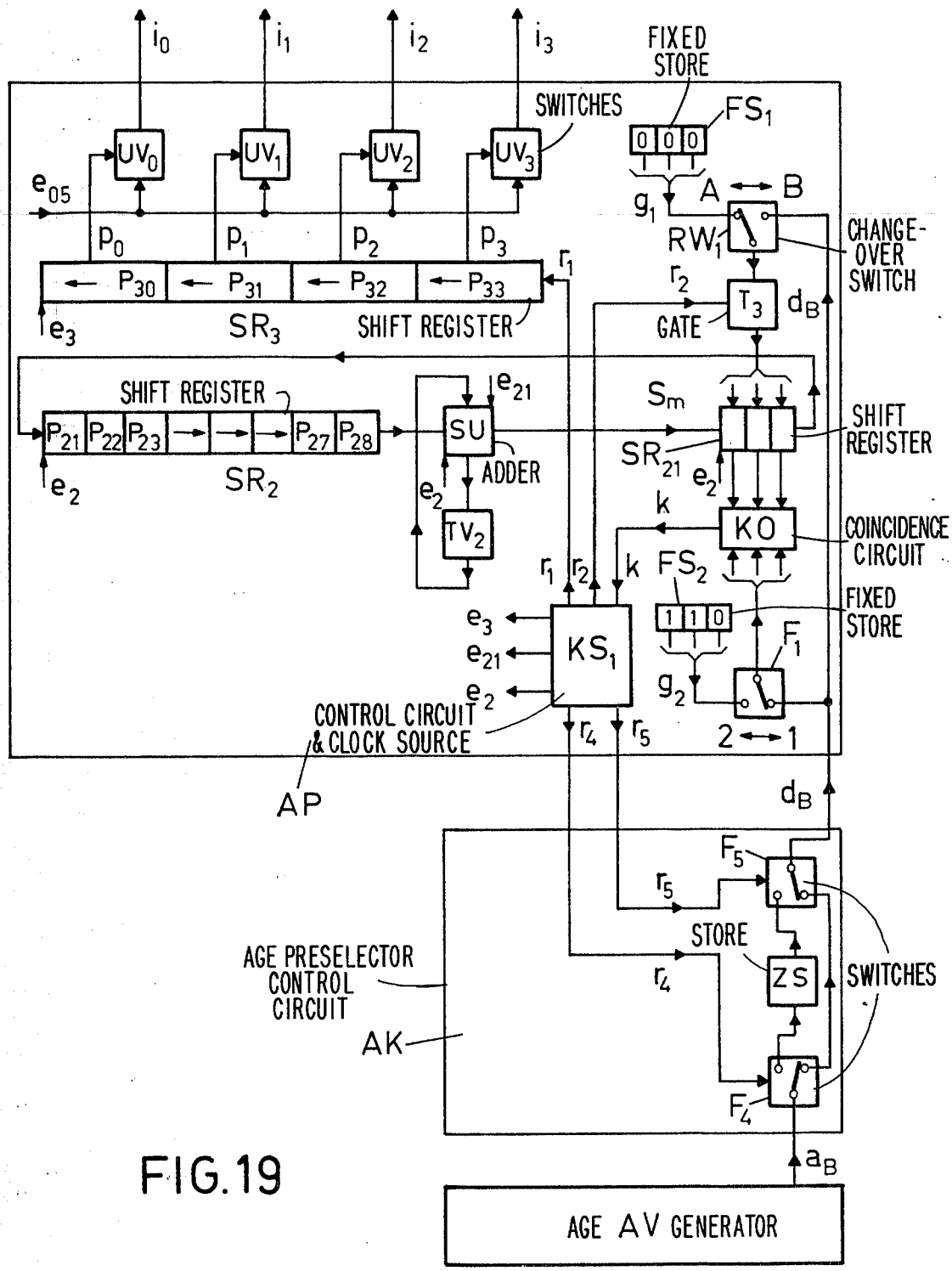
Figure 20:
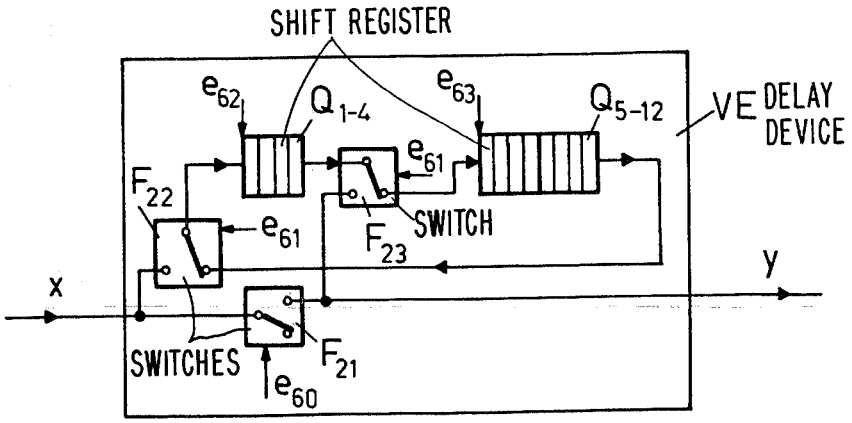
Figure 21:
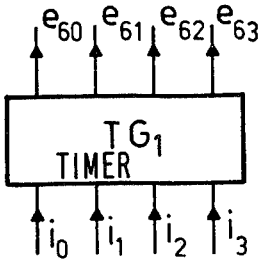
Figure 22:
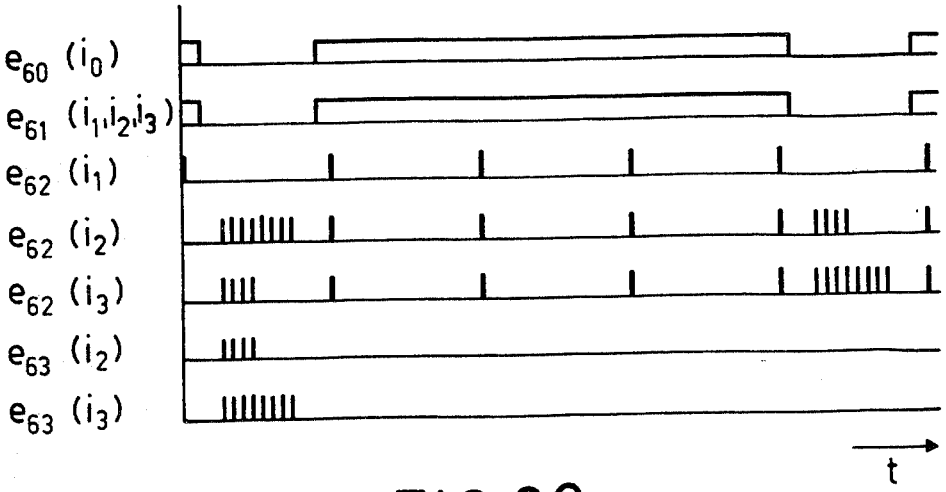
Figure 23:
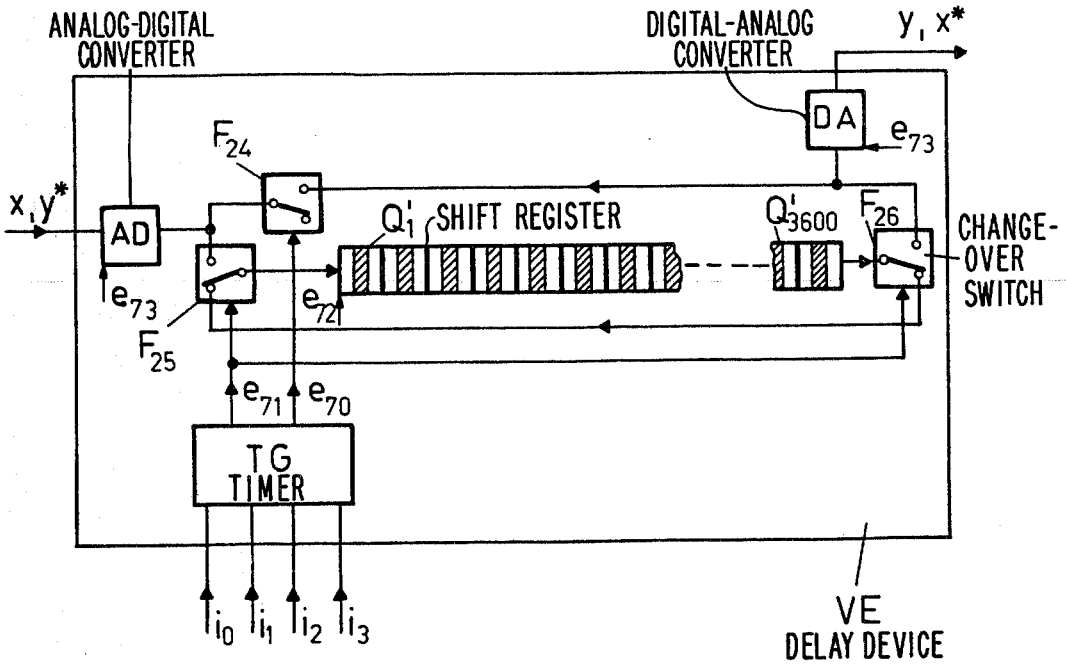
Figure 24:
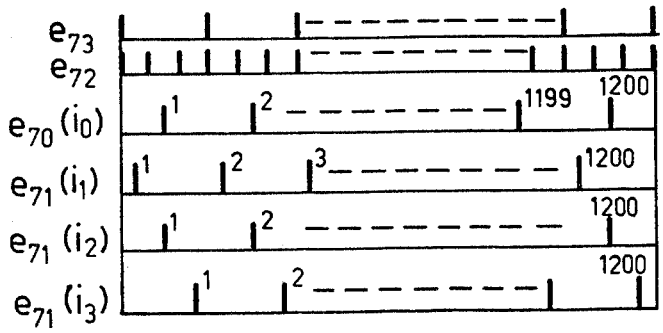
Figure 25:
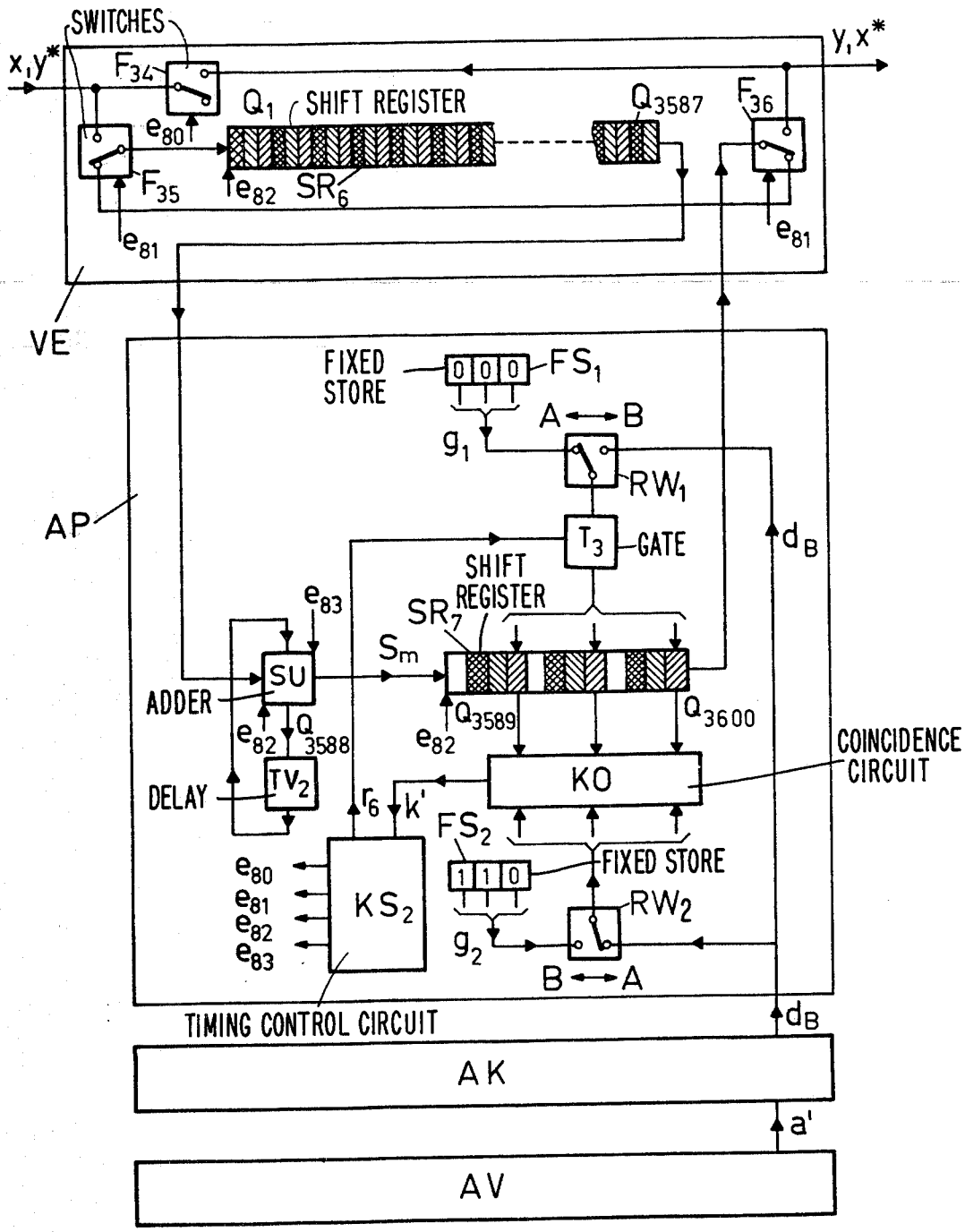
Figure 26:
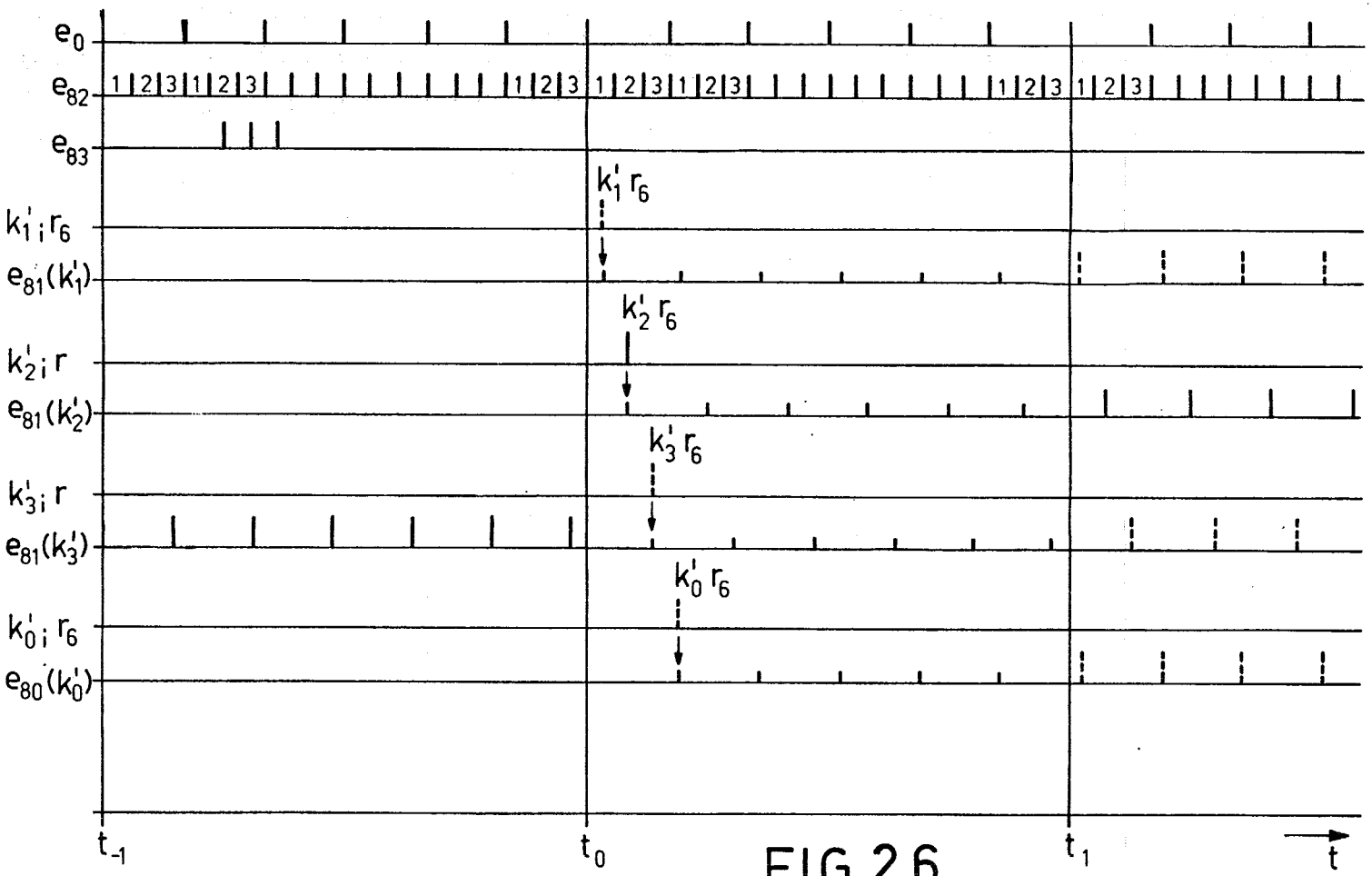
Figure 27:
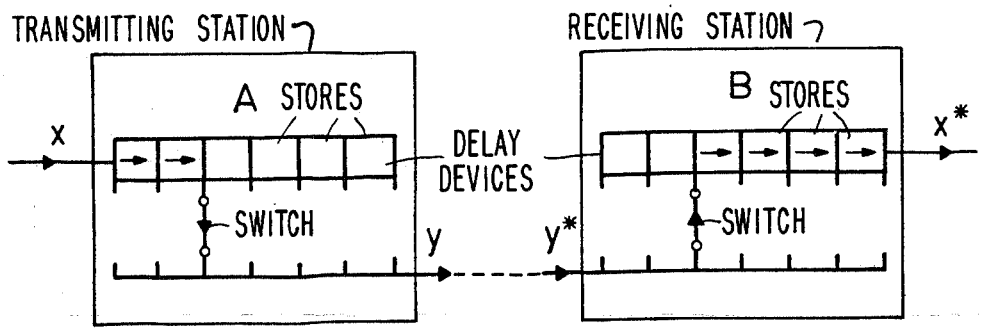
Figure 28:
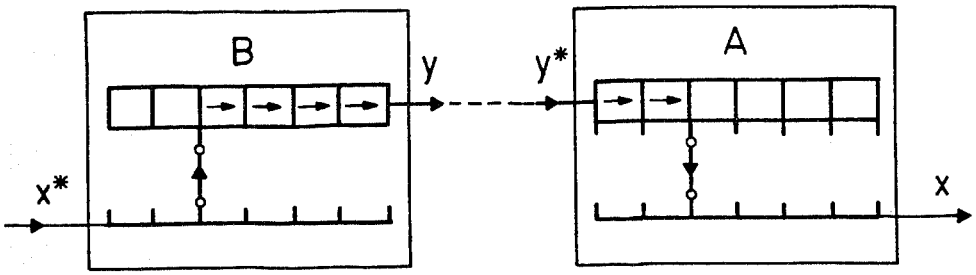
Figure 29:
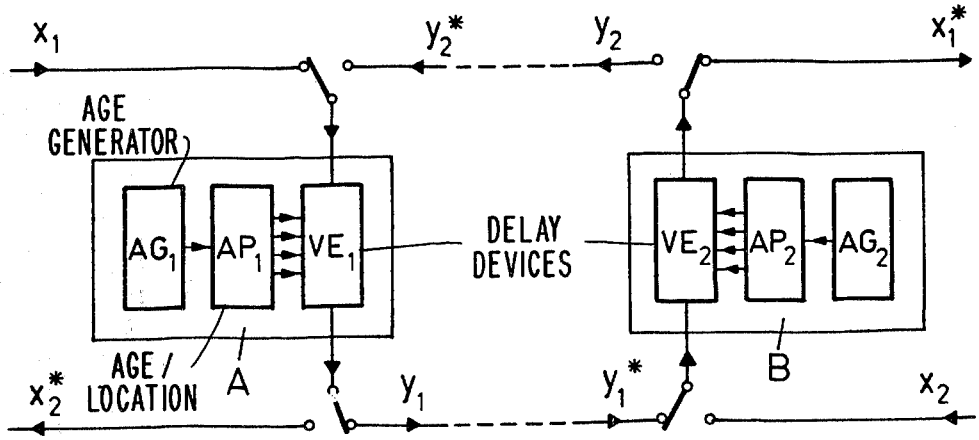

FIGS. **4*a* and 4*b* are block diagrams showing the switch connections capable of being established by the switching of FIG. 4**;

FIGS. 6 and 7 are block diagrams which illustrate apparatus respectively employed at the transmitter and at the receiver for age correction which avoids storage for delay times which are unsuitable and lead to the limiting age being exceeded;

FIG. 8 is a graphical representation of the ageing with mutually independently operated stores (parallel store) shown in simplified fashion as to the manner of relationship between the stores and the waveforms;

FIGS. 9 and 10 are block diagrams which illustrate respectively the conversion of the age control with series and with parallel storage;

FIGS. **9*a*–9*c* are block diagrams of the switch connections of the permuting unit of FIG. 9**;

FIGS. 10a–10c are block diagrams of the switch connections of the permuting unit of FIG. 10;

FIG. 11 is a graphical representation of the ageing with a series store shown in simplified fashion to explain the relationship between the waveforms and the stores;

FIG. 12 is a graphical representation of the ageing at the transmitter and receiver (both shown in simplified fashion), as a basis for explaining ageing correction;

FIGS. 13–16 are block diagrams which illustrate arrangements for age determination with quasi-random coding signals and for ageing correction;

FIGS. 17 and 19 respectively show block diagrams which illustrate encoding arrangements with age storage for transmitter and receiver operation and FIG. 18 shows the appropriate auxiliary signals helpful in explaining the operation thereof;

FIGS. 20 and 21 are block diagrams which illustrate serial storage without random access with clock generator and FIG. 22 shows a representation of the auxiliary signals derived therefrom;

FIGS. 23 and 25 are block diagrams which illustrate serial storage with smoothed sampling values, and FIGS. 24 and 26 show the appropriate timing signals and control signals developed thereby;

FIGS. 27–29 are block diagrams which illustrate a modification of the transmitter.

Figure 30:
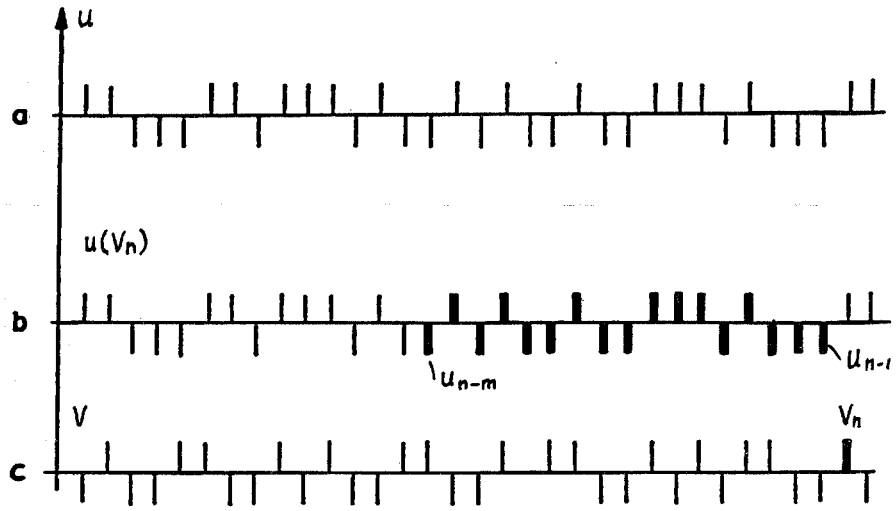
Figure 31:
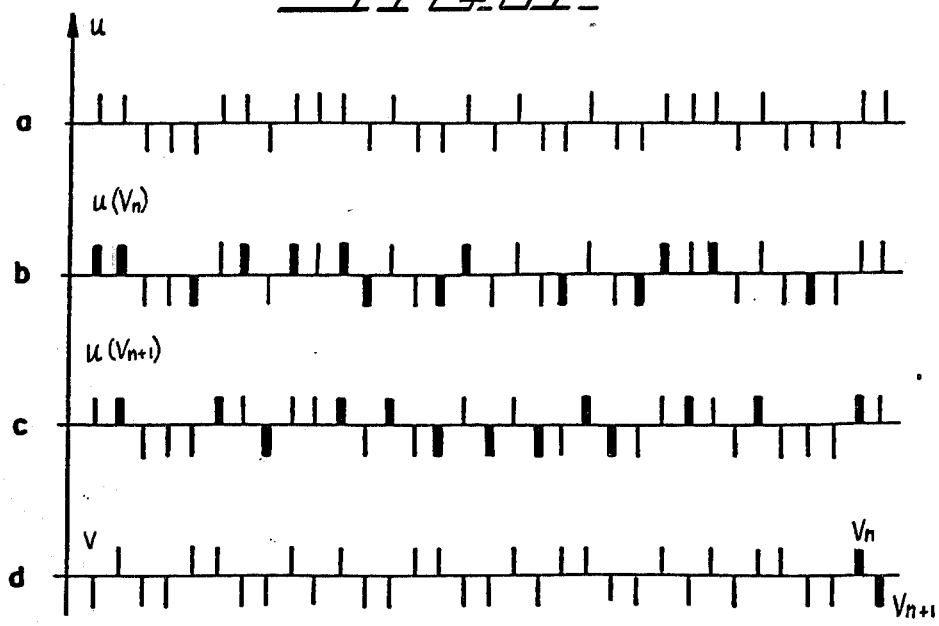

FIGS. 30 and 31 are graphs which illustrate the operation of program transformers which are typified in FIGS. 32 through 34.

FIGS. 32 through 34 are block diagrams illustrating several program transformers.

Figure 35:
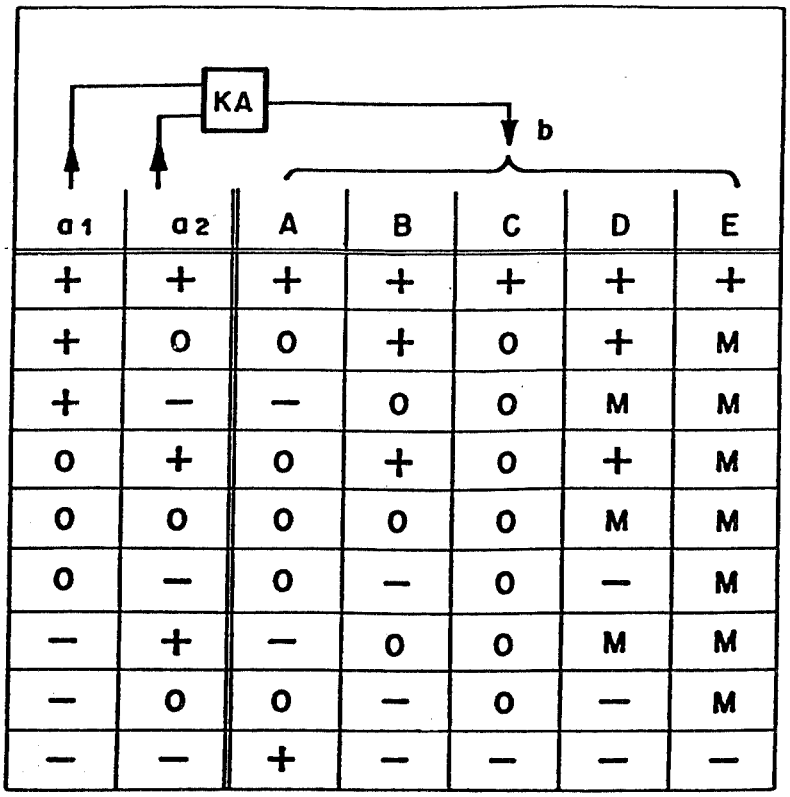

FIG. 35 is a table illustrating several alternative programs which may be utilized in connection with the program transformer of FIG 34.

DETAILED DESCRIPTION OF THE INVENTION

Figure 1:
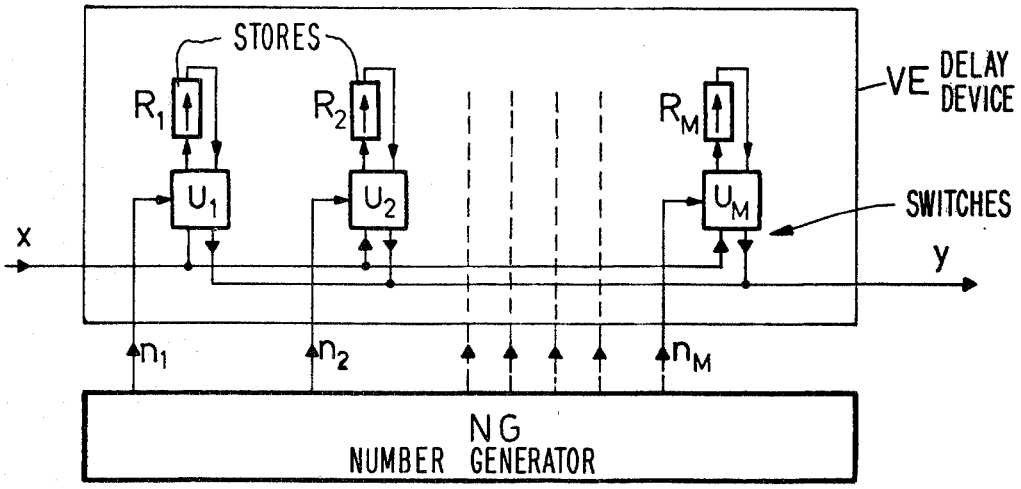
FIGS. 1 and 2 are block diagrams which illustrate known arrangements.

In the known arrangement shown in FIG. 1 elements of uniform length of the clear signal x are each entered by way of switches $U_1, U_2 \ldots U_M$ into a store $R_1, R_2, R_M$ of the delay device VE, and after varying times are withdrawn again as elements of the encoded signal y. Entry and withdrawal takes place simultaneously, so that the store always remains occupied. The switches are actuated by control signals $n_1, n_2, \ldots n_M$ (number signals) which are generated in number generator NG and appear quasi-randomly with equal probality. The disadvantages of such arrangements have already been explained.

Figure 2:
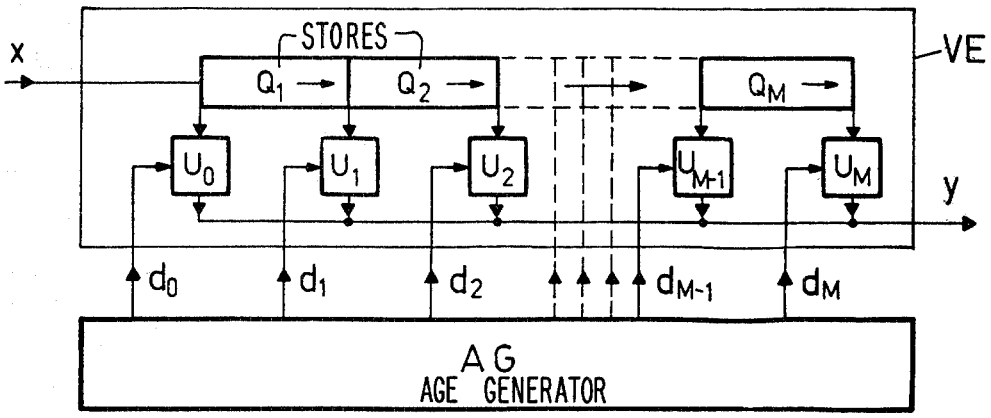

In the arrangement of FIG. 2 a uniform age-distribution of the stored elements is avoided by developing in age generator AG age numbers of equal probability, which as age signals $d_0, d_1, \ldots d_M$ actuate the switches $U_0, U_1 \ldots U_M$ for withdrawal of elements of the encoded signal y from selected individual stages $Q_1, Q_2 \ldots Q_M$ of a delay chain in delay device VE. These stages are thus only occupied from time to time, so that the cost for long delay times becomes relatively high.

Figure 3:
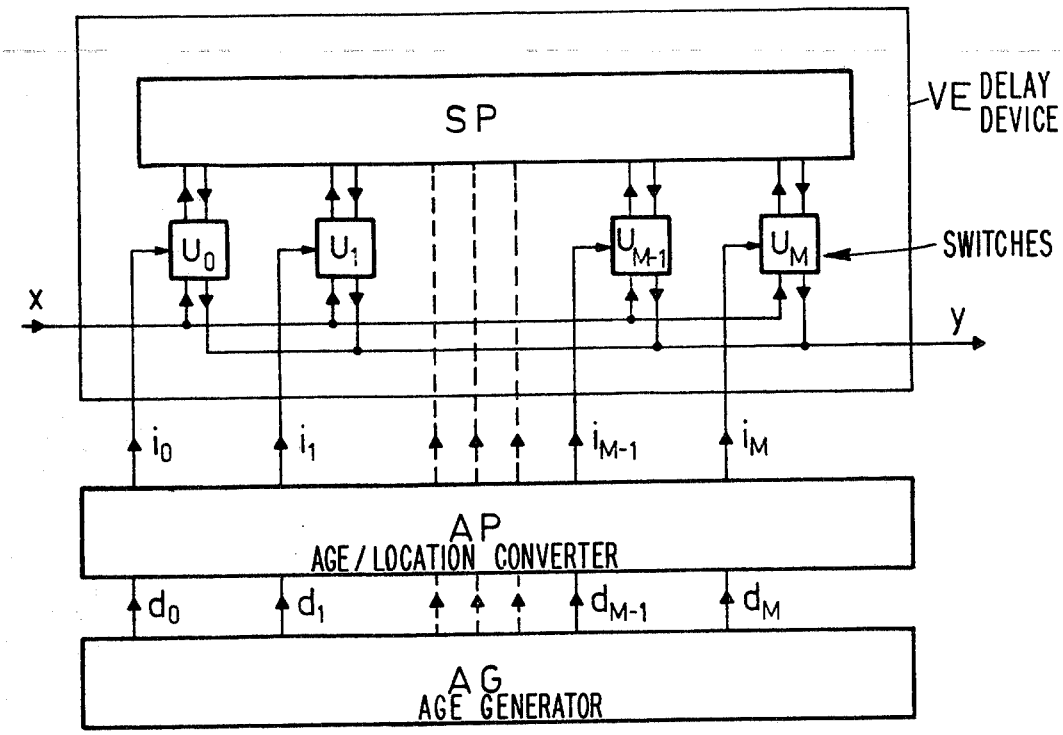
FIG. 3 is a block diagram which illustrates the method of the invention including age determination by random counting and determination of the storage location from the predetermined age for optimum storage utilization.

In accordance with the invention, as shown in FIG. 3, an element of the clear signal x is applied to the individual stages of the signal store SP by way of one of the switches $U_k$ and an element of the encoded signal y is simultaneously withdrawn from the same store $R_k$, so that all stages remain occupied by signals. These switches $U_k$ are however actuated by control impulses i, which are developed in an age/location converter AP from the age signals d, so that all delays appear with the desired mean frequency, while the limiting age value is not exceeded and repetition or omission of individual elements is avoided. Optimum utilization of the store can thus be ensured while non-uniform age distribution is avoided.

Figure 4A:
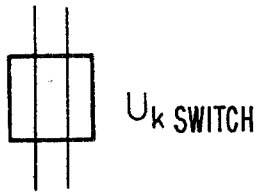
Figure 4B:
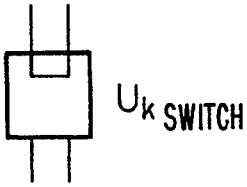

The construction and operation of an age/location converter AP will now be described with reference to FIG. 4. A delay device VE again contains individual stores $R_1 \ldots R_M$ with the respective switches $U_1 \ldots U_M$. A further switch $U_0$ allows the undelayed passage of individual message elements. During entry and withdrawal of a message element from a store $R_k$ or for direct passage of an element the respective switch U establishes the connections shown in FIG. 4a, while the connection shown in FIG. 4b is present in all the other switches. The connection of FIG. 4a is established in a switch $U_k$ by an appropriate control signal $i_k$. These storage control signals are developed in an age/location converter AP from age signals $d_B$ which are obtained in binary coded form from an age generator AG. Each age control impulse $i_k$ starts a counter $Z_k$ so that the instantaneous counter condition (age count) corresponds to the storage time of the element since the entry of a message element, expressed in element lengths. If, for example, an element delayed or "aged" by 4 element lengths is to be taken from the delay device VE, then through the application of an age signal $d_B = 100$ (which is the binary coded form of the decimal number 4) to the age/location converter AP, the counter which is now set at 100 is selected. This can be effected for example by means of a coincidence circuit $K_k$, which responds to coincidence between the instantaneous counter signal (age signal) $z_k$ and the age signal $d_B$. Upon coincidence there appears at the output of coincidence circuit $K_k$ an impulse $i_k$ which is applied to switch $U_k$ to effect withdrawal of the element of desired age and the entry of a new element into the store $R_k$. It must naturally be assumed that the age signals are of such a nature that the age limit is not exceeded and that no omission or repetition of individual elements occurs. This is ensured by a special age corrector AK which frees the preliminary age signals $a_B$ developed in AV from defects which may occur. The preliminary age signals are derived for example from quasi-randomly occurring encoding signals w by the use of logic circuits, as described below with reference to FIGS. 14 and 16. The encoding signals may be generated by a known arrangement (see Swiss Patent Specification No. 361,839). This arrangement is described in some detail in the appendix hereto. For decoding at the receiver the elements of the received encoded signal are brought again into the original sequential order of the clear signal by repeated individual delays. Each element receives, through the delay at the transmitter and the additional delay at the receiver, the same total delay, e.g. by N elements, so that the decoded signal x* is always displaced by N elements with respect to the original clear signal x. The decoding apparatus shown in FIG. 5 again contains an arrangement AG* for deriving coded age signals $d_B^*$, which correspond with the age signals $d_B$ at the transmitter, and an arrangement VE* for delaying the signal elements. An element already delayed at the transmitter by h element lengths must be delayed by a further N-h element lengths. To monitor this additional ageing there are provided in age/location converter AP* the counters $Z_1^* \ldots Z_M^*$, which like the counters at the transmitter are advanced by clock pulses in rhythm with the element changes. At the receiver the age counting begins each time with the age number of the respective element which was reached at the transmitter. During the storage of the element at the receiver the count is advanced until it reaches the limiting age of N elements, i.e. until a count of N is reached. At this instant there appears at the counter an age limit impulse $i_k$, which by actuation of the switch $U_k$ effects the withdrawal of the element from the store $R_k$ and its advance as the clear signal x*. At the same time there is applied to the same store the just arriving element of the received signal y*. There is also supplied to the age store $V_k$ the individual store control impulse $i_k$ agreeing with $v_k$, by means of which the age signal associated with the new element received is conducted to the counter $Z_k$* as a starting signal $z_k$*. The counter is thus advanced again until the number N is reached, that is, upon attaining a total ageing of the element by N element lengths, whereupon this element also is introduced into the clear signal x*.

If the ageing at the transmitter already amounts to N element lengths, then additional storage at the receiver must not occur. The age signal $d_B$* is then responded to only by a decoder $V_O$ sensitive to this signal, which yields a switching impulse $i_O$* for direct transmission of the element by way of the switch $U_O$.

The count M of the individual stores contained in the delay device VE or VE* is less than the number N, which corresponds to the maximum delay in element lengths and thus also to the sum of all possible delays. In general, M=N/2. For this reason elements of all possible ages are not present in the delay device at any one time. Despite this satisfactory operation is ensured since by means of the age corrector AK or AK* the ages not available in VE, or already occupied in VE*, are automatically avoided.

The preliminary age signals $a_B$ derived from the quasi-randomly occurring train of encoding signals w have a random character and for this reason are not always suitable for proper control of the age/location converter AP and the delay device VE. The following conditions must always be maintained at the transmitter:

(1) Only those age signals $d_B$ should be developed that correspond to the age of one of the elements available in the delay device VE;

(2) Whenever an element of maximum age (limiting age) appears in the delay device, than in all cases this element must be called up.

An arrangement which fulfills these requirements is shown in FIG. 6. The age/location converter AP corresponds to the circuit of FIG. 4, the number of storage locations to be controlled being restricted to three for the sake of simplicity in illustration. When they reach the maximum age number, the age counters $Z_k$ provide an age limit pulse $v_k$ which notifies the respective store $R_k$ in VE (FIG. 4) that the age limit is reached. The age generator AG contains, in addition to the preliminary age selector AV, which yields preliminary age signals $A_B$, an age corrector AK for replacing these preliminary signals when one of the conditions mentioned as items (1) and (2) above is not fulfilled. If the age signal $D_B$ next applied simultaneously to all of the coincidence circuits K of the age/location converter is not appropriate, then a corresponding age number does not appear on any one of age counters $Z_k$; that is, an output signal does not result from any one of the coincidence circuits $K_k$. At OR gate $G_{61}$ with negated output there thus results a repetition impulse u, which causes the preliminary age selector AV to provide a further preliminary age signal $a_B$. If necessary this process is repeated until, when condition (1) is fulfilled further repetitions are suppressed. Instead of developing a completely new preliminary age signal, the unsuitable preliminary signal could be altered once or more often by the addition of a particular binary number until condition (1) is fulfilled. When a limiting age is attained an age limit impulse $V_k$ appears even before the application of the next preliminary age signal $a_B$, which is applied by way of OR gate G62 to gate T as an inhibiting pulse, so that the preliminary signal path remains interrupted. The age limit impulse $v_k$ is also applied to one of the stores of the delay device VE as a control impulse $i_h$ for an individual store, so that removal of the element stored up to the age limit takes place by way of the switch $U_k$ (FIG. 4). Fulfillment of condition (2) is thus likewise ensured.

The age signals at the receiver also have to fulfill definite conditions:

(1) Only those age signals should be developed which do not correspond to the instantaneous age of an element already stored in the delay device VE*;

(2) If no element of maximum age (limiting age) is present in the delay device, then the element received at that time must be transferred undelayed into the decoded signal.

If condition (1) is not fulfilled, two elements of the same age appear in the delay device and will be simultaneously withdrawn upon reaching the maximum age. As for the arrangement at the transmitter, a new age signal must therefore be found, until condition (1) is fulfilled. Because of the similar construction and programming of the preliminary age selectors AV and AV* at the transmitter and receiver the age signals finally found at the transmitter and receiver again correspond. The maintenance of conditions (1) and (2) at the transmitter makes it certain that all elements of the clear signal reach the receiver, and that the age limit is never exceeded. Because of condition (1) at the receiver an element of limiting age must thus finally be available at the receiver output at every moment of time. If such a signal is not present in the delay device, than the element received at that time must already have the maximum age and it should not therefore be further delayed. This results in receiver condition (2).

A device in accordance with FIG. 7 serves to maintain these conditions (1) and (2) at the receiver. The age/location converter AP* again contains the age counters $Z_k$* which, on reaching the age limit number yield an age limit impulse $i_k$*, which is passed on to the delay device VE* (FIG. 5) as the individual store control signal $i_k$* and at the same time controls the age-gate $V_k$, so that a new age signal $D_B$* is passed to the counter through this gate and sets this to the corresponding initial position: $z_k$*=$d_B$*. For monitoring in relation to condition (1) there are also provided in AP* the coincidence circuits $K_k$*, which provide an output pulse $u_k$* when the age number counted agrees with the binary coded age signal $d_B$. Since the storage of elements with equal age numbers is prohibited, $u_k$* is conducted through the OR gate $G_{71}$* to age preselector AV*, where the input signal u* results. The age corrector AK* also contains an OR $G_{72}$* with negated output, which yields an impulse v* when no age limit impulse $V_k$* occurs. The impulse v* is applied to the switch $V_0$ (FIG. 5), so that the message element then received passes undelayed directly to the output of the decoding device as a component of the clear signal x*, corresponding to receiver condition (2). Since age correctors AK and AK* shown in FIGS. 6 and 7 derive their criteria from the age/location selectors AP and AP*, coupled age correction is provided.

The transmitter and receiver aging operations in the mutually independent stores $R_k$ and $R_k^*$, on the assumption of three stores, are graphically illustrated by way of example in FIG. 8. The time scale t is calibrated in element lengths. The elements E (input) are numbered by indices in the original sequence. It is seen, for example, that at the transmitter the message element $E_6$ is applied to the store $R_1$ at the instant 6 and after one element length is again withdrawn from the store, while at the same time elements $E_2$ and $E_4$ which were entered in the stores $R_2$ and $R_3$ at times $t_2$ and $t_4$ respectively are still stored. In accordance with the switching diagram seen above, applicable to instant 6, the input and output of $R_1$ are connected with the input signal x and with the output signal y respectively, while the outputs of the two further stores are connected with their own inputs, so that the elements stored therein circulate. The element withdrawn at instant 7 is already delayed by one element length and is therefore designated $E_6^1$. After transmission to the receiver in the encoded signal y* it is further delayed by 5 elements, so that it finally appears in the reproduced clear signal x* as element $E_6^{1+5}$ with the total age of 6 element lengths. On the assumption that the apparatus at the transmitter is first switched on at the time $t_s$ following instant O, while the apparatus at the receiver was in operation even before that, then for example at instant 1 a still 'empty' element $E_0^1$ of age 1 is withdrawn from the store $R_1$ (shown in broken line), that is called up by an age signal $d'=1$, after a first age signal d did not meet the previously discussed transmitter condition (1). A further "empty" element $E_0^2$ of age 2 follows at instant 2 being called up by the age signal $d''/=2$ which was preceded by two age signals unsuitable because of the same condition. At the output of the receiver apparatus 'empty' elements appear first of all, until the clear signal elements appear in the original sequence with individual total delays of 6 elements. At instant 7 is shown the first transmitter age signal, designated (d=2). Because of unavailability in the age store, in accordance with condition (1) it is called up again, so that the usable age signal $d'=1$ appears, which effects withdrawal of the element $E_6$ delayed by one element length. At time 5 the age signal $d=0$ appears, that effects a direct transmission of the element $E_5$. At time 8 there appears the age signal $d=1$, that would otherwise be satisfied by the element $E_7$. Because of transmitter condition (2), however, the element $E_2^6$ already delayed by 6 elements (age limit) is transmitted. At the same time the age limit number appears in none of the receiver age counters, that is, no element of limiting age is present in the store R*, so that in accordance with receiver condition (2) the received element $E_2^6$ is conducted to the output as element $E_2^{6+0}$. The receiver age signal $d^*=1$ is not taken into account, since no age counter and also no store is free. It should be noted that the transmitter and receiver preliminary age selectors AV and AV* always supply corresponding age signals and that also because of condition (1) at both ends the additional age signals provided for age correction are alike.

Figure 5:
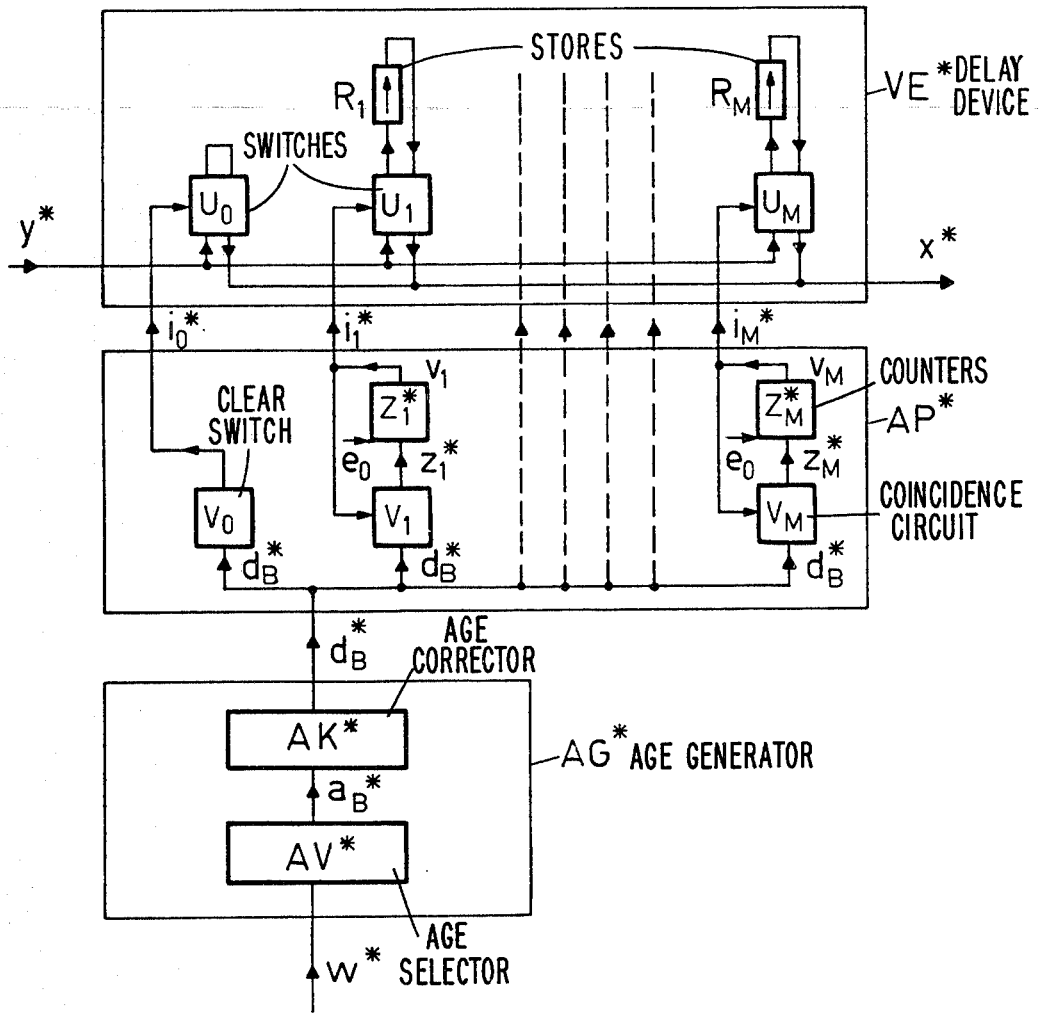

In the delay devices shown in FIGS. 4 and 5 the elements are aged in independent individual stores $R_k$ and $R_k^*$, return from the output to the input of these stores being provided for greater delay times. This is a parallel storage arrangement, since no element passes through different stores in succession. However, a series connection of the stores may alternatively be used, as shown in FIG. 9, longer delay times being this attained, since one element passes through several individual stores $Q_k$ in succession. The change-over switches $U_k$ lying between these stores are here switched in accordance with FIG. 4*b*, while the switch settings of FIG. 4*a* apply for the entry of the elements into this chain and their withdrawal from it. In controlling the switches, care must be taken that an element entered at time 1 by way of switch $U_1$ passes after one element length through switch $U_2$, after two element lengths through switch $U_3$, after three element lengths through switch $U_1$ again, and so on, while in parallel operation as in FIG. 4 the corresponding element continuously passes through the switch $U_1$. When the control impulse $i_k$ from an age/location converter AP as in FIG. 4 is used, an additional permutation of this impulse in accordance with time is necessary as shown in FIGS. 9*b* and 9*c*, while direct signal transfer is permissible only at times 1, 4, . . . , as shown in FIG. 9*a*. When using an age/location converter $AP_i$ suitable for parallel operation, as shown in FIG. 9, when series storage is employed, an additional permuting device RQ is thus necessary for deriving the new control impulses $j_k$ for the series store.

By similar reasoning the requirement developed, that the control pulses $j_k$ taken from an age/location converter $AP_j$, which are suitable for controlling the switches $U_k$ of a series store, are to undergo an additional permutation if they are to serve for controlling the switches of a delay device $VE_i$, the individual stores in which are provided for independent parallel operation as shown in FIG. 10. The permutation then take place as shown in FIGS. 10*a*, 10*b*, 10*c* and are controlled by permutating unit QR. The control impulse $i_O$ or the corresponding $j_O$ for direct transfer of an element is not involved in a permutation in either store (FIGS. 9 and 10) since this element is not delayed.

The transmitter and receiver aging processes for serial storage are graphically represented by way of example in FIG. 11; on the assumption of the same aging program as for the parallel storage of FIG. 8. The control impulses are thus derived from the impulses effective in accordance with FIG. 8 by permutation in accordance with the rules illustrated by FIGS. 9*a*, 9*b* and 9*c*. The representation shows the movement of the element beginnings through the individual delay stages and their passage to the input and output of the store.

The illustrated switching and storage diagrams for parallel and serial storage are only provided as examples of the aging of the data elements in the use of the invention. Other exampls may be seen from FIGS. 20 and 23, and other embodiments may be provided without difficulty by making use of techniques presently available.

Measures for correcting the aging control are dealt with with reference to FIGS. 6 and 7, which meet the transmitter and receiver requirements for proper interchange of the elements by arrangements with optimum storage utilization. Equally valuable results are also obtained by deriving the age signals with a model which does not initially correspond to optimum utilization. In FIG. 12 there are shown on the model of the known arrangement of FIG. 2, shifting registers to be placed at the transmitter and the receiver, with the respective individual stages $Q_k$ and $Q_k^*$ respectively, from the tappings of which the data elements are selectively withdrawn at the transmitter and to the tappings of which the elements are correspondingly applied at the receiver. When transmitted signals y or y* appear, the elements of the clear signal x appear in different sequences, and for the receiver output signal x* the sequence of the clear signal is reinstated, if the tappings selected at any time at the transmitter and receiver always correspond, as can be seen in the diagram given therebelow. Thus in this case the total aging of all elements up to the receiver output is always of the same magnitude. It is easily seen from the transmitter diagram that each element is to be withdrawn from the store only once, and that the withdrawal must take place at the latest after the element has passed completely through the store. From this there result the transmitter conditions:

(1) in place of each withdrawn signal there passes through the store an "empty" or replacement signal, the subsequent withdrawal of which is inhibited;

(2) when an element reaches the last store then in every case it must be withdrawn.

From the receiver diagram, on the other hand, it can be seen that for the entry of received elements only those stages of the store can be considered which are still free, and that a received element must be taken directly to the output in all cases when the last stage of the store is still free. There thus result the receiver conditions:

(1) Stages of the store already occupied by elements are inhibited from further entry of an element;

(2) If the last stage of the store does not contain an element, then the element next received is to be taken to the output of this stage.

In the example of FIG. 12 the same preliminary age signals are assumed as in FIG. 11. If transmitter or receiver requirement (1) is not fulfilled, further preliminary signals are called up in the same manner. A comparison of the two diagrams shows that equal storage times always result in the two cases. It is thus also possible to attain the same encoding results if the store of FIG. 12 is subsequently replaced by a store with optimum storage utilization, when FIG. 12 may be retained as the model for the dimensioning of the storage times. Such an example is shown later in FIG. 17.

Figure 13:
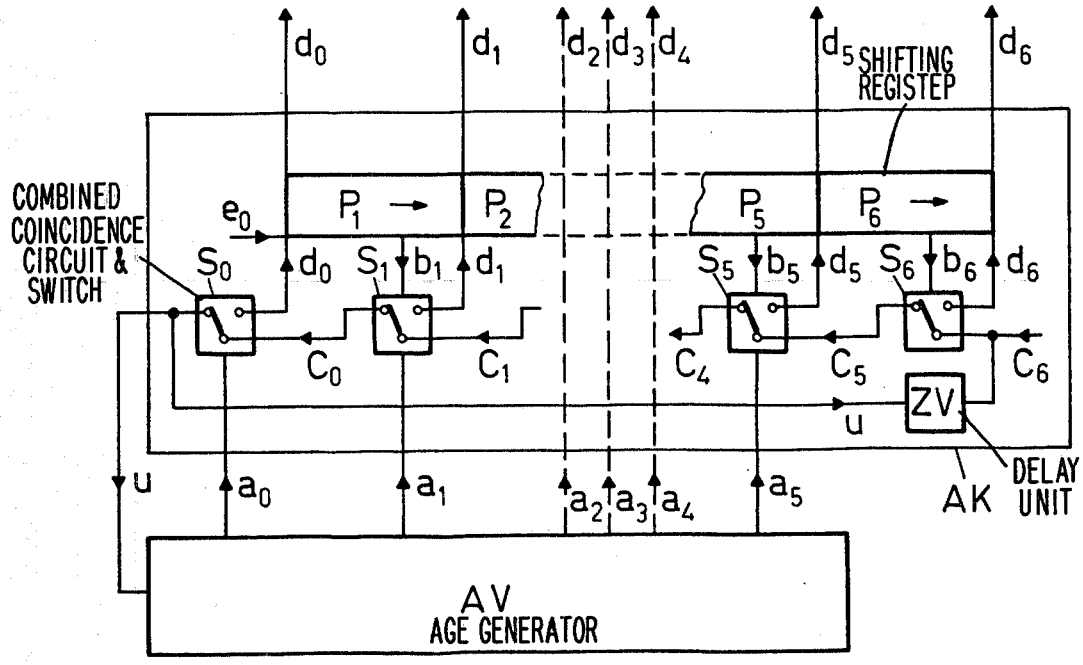

FIG. 13 shows a device which automatically supplies the age signals $d_k$ for determining the register tappings as in FIG. 12, taking account of the relevant conditions. To do so, a model register having stages $P_1 \ldots P_6$ is used, the input stage of which is first occupied at each step of the clock signal $e_0$. If the last stage is already occupied then, in accordance with condition (2) an output pulse $d_6$ must be supplied by the control stage $S_6$, since the occupying signal $b_6$ then present in the stage sets the switch in $S_6$ into the actuated position (the opposite position to that shown in FIG. 13), so that the periodically applied clock signal $C_C$ can be passed on. If the last register stage is already free, then all the switches $S_k$ are in the unactuated condition (as shown) until a preliminary age impulse $a_k$ is applied from the preliminary age selector AV. If the preliminary impulse (e.g. $a_1$) is applied to the respective register (e.g. $P_1$) at the same time as the address impulse (e.g. $b_1$), then the respective switch (e.g. $S_1$) is set to the actuated position, so that the auxiliary pulse $C_1$ from the following switch is passed on as an age pulse $d_1$ and at the same time inhibits the transfer of the register contents from $P_1$ to $P_2$.

The "empty" signal then travels through the register and inhibits a repeated provision of an age impulse in violation of condition (1). If a register stage (e.g. $P_1$) should be already emptied, then the respective occupation signal (e.g. $b_1$) is absent and the respective control switch (e.g. $S_1$) is itself not actuated when the called-up preliminary impulse (e.g. $a_1$) is applied to its. When for this reason no age impulse $d_k$ is developed, then all the switches remain in the unactuated condition, so that owing to the passage of the clock signal $C_6$ through all the switches a repetition impulse u is produced, which gives rise to the repeated provision of a preliminary age impulse by AV. After a brief delay in auxiliary delay unit ZV, the repetition impulse u passes through the switch chain as a new trigger impulse C, until finally, upon coincidence of a new preliminary age impulse with an occupation impulse, a usable age impulse $d_k$ results, which fulfills the transmitter condition (1). An arrangement in accordance with FIG. 13 may also be used to find the receiver age impulses $d_k^*$, since these must always correspond to the transmitter impulses $d_k$. As is shown by a comparison of the diagrams of FIGS. 8, 11 and 12, and the respective conditions, the operation of the age controls of FIGS. 6 and 13 is alike by additional means it is sought to ensure that in FIG. 13 also, by suitable age/location conversion, operation with optimum storage utilization is produced.

An important characteristic of the proposed arrangement is that all element displacements occur in the encoded signal with the same frequency, or with a specified frequency distribution. Starting from FIG. 13 the following relations apply, which may however be transferred unchanged to another age control of like performance, such as that of FIG. 6, for example. The switches $S_k$ are actuated in response to the simultaneous application of $a_k$ and $b_k$; i.e.

$$d_k = a_k b_k c_k$$

$$c_{k-1} = \bar{d}_k c_k.$$

On the assumption that the signals a, b, c, d, occur with the respective probabilities A, B, C, D, and that for successful selection of an age impulse d, W age selections are necessary on average, the following is approximately true for large numbers of stages:

$$D_k = A_k W \; W B_k C_k (k < H). \tag{1}$$

If all delays appear with equal probability, then for a number H of stages P in the storage register used in AV, i.e. for H + 1 different possible ages, $$D_k = D = 1/(H+1), \tag{2}$$

and the probability B that a particular stage is occupied diminishes by D with each stage:

$$B_k = 1 - kD = \frac{H+1-k}{H+1}. \tag{3}$$

In accordance with requirement (2), $d_H$ must appear in all cases when the last register stage is still occupied; i.e. it is necessary that $C_H = 1$. After the age impulse $d_H$ has appeared at any time the condition for the switch $S_k$ to be actuated by $a_k$ is:

$$C_k (k < H) = 1 - D_H = \frac{H}{H+1},$$

and by substituting from (2) and (3) in equation (1)

$$A_k W = \frac{D_k}{B_k C_k} = \frac{H+1}{H(H+1-k)}. \quad (4)$$

On the assumption of six register stages (H = 6) we have:

$$\sum_{k=0}^{H-1} A_k W = \frac{H+1}{H} \sum_{k=0}^{H-1} \frac{1}{H+1-k} = 1.86,$$

this being of course only an approximation because of the small number of stages. Because $$\sum_{k-0}^{H-1} A_k = 1$$

would therefore give W = 1.86, from which the probabilities $A_k$ may be determined in accordance with equation (4):

| | | |
|---|---|---|
| $A_0$ = | 0.090 | 3/32 |
| $A_1$ = | 0.105 | 3/32 |
| $A_2$ = | 0.125 | 4/32 |
| $A_3$ = | 0.157 | 5/32 |
| $A_4$ = | 0.209 | 7/32 |
| $A_5$ = | 0.314 | 10/32 |
| | 1.000 | 32/32 |

Figure 14:
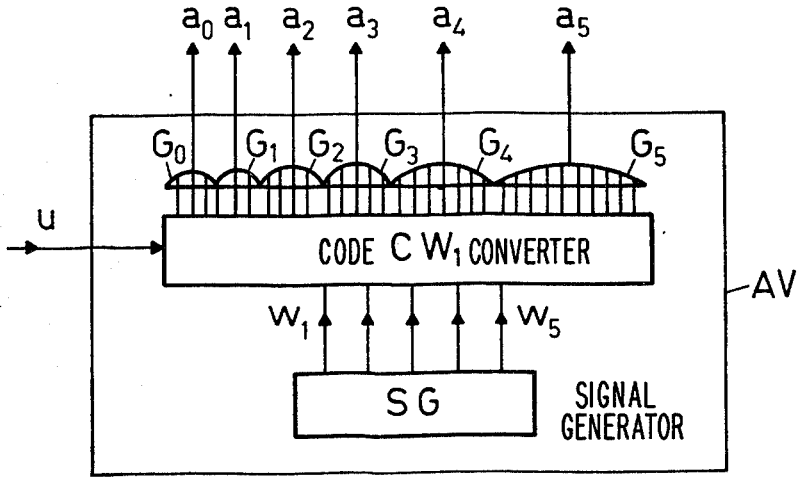

The age selection can be effected with an arrangement AV as shown in FIG. 14, in which a coding signal generator SG yields on each occasion a code word consisting of five binary digits $W_1$–$W_5$ in quasi-random distribution. From this code word there is developed in a code converter $CW_1$ an individual impulse at one of 32 outputs, the locations of these impulses being again interchanged in accordance with the laws of chance. By the combination of three outputs in OR gate $G_0$ the preliminary age impulse $a_0$ appears with the probability 3/32, while the preliminary impulses $A_1$–$A_5$ appear at the outputs of the gates $G_1$–$G_5$ with the approximate probabilities given in the table above. By the use of logic circuits in accordance with known techniques, other devices for obtaining age impulses with the desired probability distribution can of course be built.

Figure 15:
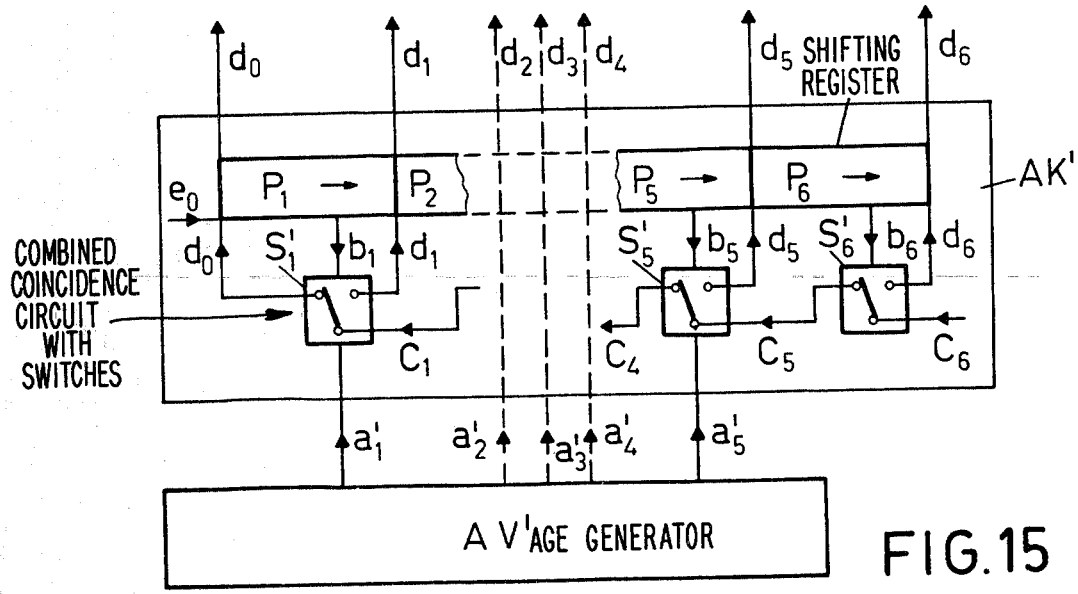

In FIG. 15 there is shown an age generator consisting of an age preselector AV' and an age corrector AK', which again provides age impulses $d_k$ with uniform probability distribution. For each age selection, however, the age preselector AV' yields several impulses $a_k'$, of specified probability distribution. A storage register with the individual stages, $P_1, P_2, \ldots P_6$ is again fed with input impulses in rhythm with the clock signal $e_0$, which in the course of their passage through the register are withdrawn upon the appearance of an age signal $d_k$. The switches $S_k$ are again actuated upon the simultaneous appearance of a preliminary impulse or release impulse $a_k'$ and an address impulse $b_k$, $$d_k = a_k' b_k c_k.$$

And since no repetition occurs in the age selection (W = 1), the probability of the negative signals is given by:

$$D_k = A_k' B_k C_k \quad (5)$$

$$C_k = C_{k+1} - D_{k+1}. \quad (6)$$

Again, for the desired uniform distribution of the age impulses:

$$D_k = D = 1/(H+1), \quad (7)$$

and $$B_k = 1 - kD = \frac{H+1-k}{H+1} \quad (8)$$

Because $C_H = 1$, we get from (6):

$$C_k = C_{k+1} - D = C_{k+2} - 2D = \ldots C_H - (H-k)$$

$$D = \frac{k+1}{H+1} \quad (9)$$

and substitution from (7), (8) and (9) in equation (5) yields $$A_k' = \frac{K+1}{(H+1-k)(k+1)} \quad (10)$$

Thus on the assumption of 6 storage stages (H = 6) there is obtained:

$$A_1' = A_5' = 7/12 = 0.583 [0.578 = 1 - (\tfrac{5}{6})^3]$$

$$A_2' = A_4' = 7/15 = 0.467 [0.469 = 15/32]$$

$$A_3' = 7/16 = 0.437 [0.437 = 1 - (\tfrac{4}{5})^2]$$

An advantage of this method is that each age selection leads reliably to the goal at little cost in time, while with the arrangement of FIG. 13 in a few cases frequency repetition of the age selection may be necessary before a useful solution is obtained.

Figure 16:
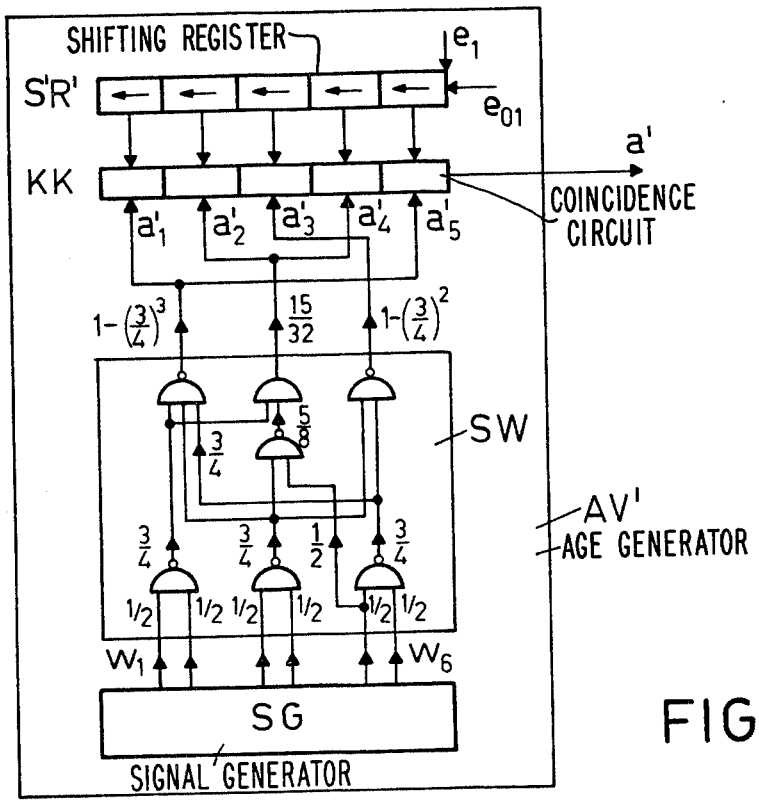

In FIG. 16 there is shown an arrangement AV' for age selection, i.e. for obtaining the preliminary age pulses $a_k'$, which are suitable as input signals for the age selector of FIG. 15. From the coding signal generator SG there are taken the six coding signals $W_1 \ldots W_6$ which consist of binary signals of quasi-random distribution. Thus there appear each time pulses of probability ½ from which there are derived in a system of logic AND gates contained in a signal converter SW a set of three further coding signals consisting of impulses having the probabilities set out in the right-hand column of the table given above. These further coding signals are used as control impulses $a_1' \ldots a_5'$ for coincidence circuits KK and their probabilities $A_1' \ldots A_5'$ will be seen from the table to correspond well enough with the theoretically determined desired values. If the preliminary age pulses are required to follow each other in a particular sequence, then the arrangement AV' of FIG. 16 may be supplemented by a shifting register S'R', through which a drive pulse $e_{01}$ is driven by a clock pulse $e_1$. At the output of the coincidence circuit KK a preliminary age impulse a' thus appears each time the drive impulse coincides with one of the impulses $a'_1 \ldots a'_5$.

Equations (4) and (10) show how the probabilities $A_k$ or $A_k'$ of the preliminary age impulses or of the age release pulses are to be chosen in order that all element delays shall appear with the same probability. Certain deviations from this requirement may be desired for cryptological reasons, e.g. a preference for large and small displacements as compared with medium values of displacement. Such requirements are naturally easily satisfied by modification of the probabilities $A_k$ or $A_k'$ and corresponding arrangement of the age selector.

Since the age correctors AK and AK' of FIGS. 13 and 15 form their criteria self-containedly, independent of the age/location selector AP, the operation may be termed independent age control.

It is shown in FIG. 12, that the age selection obtained by a shifting register model (independent age corrector) results in the same aging results as the age corrector with optimum storage utilization shown in FIGS. 6 and 7 (coupled age corrector), and that the requirements laid down for the two methods lead to the same result.

There will now be described with reference to FIG. 17 an arrangement with which the age signal found with an addressable register model (independent age corrector) may be evaluated for age/location conversion with optimum storage utilization without further correction. For the age corrector AK, the circuit of FIG. 15 is modified so that several stages $S_k$ are distributed along the addressable register. The content of the register stages P of $SR_1$ is on the contrary transferred at a faster sequence to a single switch S, by which, in the end, the same results are obtained. The stages $P_{11} \ldots P_{16}$ (FIG. 17) are next charged with the same load impulses and/or idle impulses as the stages $P_1 \ldots P_6$ (FIG. 15). With the switch S the next stage $P_{16}$ is examined and no impulse $d=d_6$ is yielded with an idle stage. On this the register contents is shifted by the clock pulse $e_1^1$ in one stage, and, with the same switch the original content of stage 15 will be examined. An exit impulse $d=d_5$ comes about only if, $b_5$ (originally in step $P_{15}$) and as $a_5^{40}$ occur in time synchronism. In the same way and in sequential fashion, the contents of steps $P_{14}$, $P_{13}$, $P_{12}$, $P_{11}$ will also be examined until the correct age impulse d results. After the response of the switch S, that is according to the information of an age impulse d, the further conductance of the impulse C to the protracted step $TV_1$ is interrupted, in which case C is recirculated during clock impulse $e_1$ when there is no switch response. According to this technique employed during a control cycle, the register contents returns to the original location. During $e_{01}$ in slow base time measure of active switch RS, a new imposed impulse will be generated because of this, which, by simultaneous forward switching of the register contents is placed in the first register stage. By the timely location of the characterized age impulse d, the three impulse stages are reset in the code variable $CW_2$ to change one of the positions of the said three-bit binary code. The variable age/location AP, according to FIG. 17 is as appropriate for use at the transmission side as it is for the reception side of a communications system. In accordance with the arrangements for transmission the switches $RW_1$ and $RW_2$ are set either to position A (transmission) or to position B (reception). The arrangement includes an age register $sR_2$ which in each three successive stages (in the circuit embodiment shown) contains a three-place binary word (age number) giving the ages of the stored elements. The three stages of the interchange register $SR_{21}$ and the summing stage SU are also to be considered as stages of this register. The whole register thus comprises 12 stages corresponding to the $2^3 = 8$ possible delays of 4 elements conducted through VE, including the zero delay obtained when switch $U_0$ is closed.

At each step of the basic clock, the contents of the register $SR_2$ circulate under the control of a fast clock pulse $e_2$. Thus each binary number entered in the register is increased by one in the summing stage SU with the delay device $TV_2$, corresponding to the increase of one element length in the time of storage in delay unit VE. This increase is avoided only with age values remaining continuously at 0, to which the switch $U_0$ is always appropriate. The respective age number 000 arrives in due sequence in the three register stages of $SR_{21}$. During transmission the register stages $P_{21}$, $P_{22}$, $P_{23}$ contain the number which corresponds to the age of the element stored in $R_3$, while the succeeding stages contain the age numbers appropriate to the age stores $R_2$ and $R_1$ and already expired. An age signal $d_B$ (e.g. 5) provided by the age corrector AK denotes that an element of corresponding age is to be called up from the delay device VE. For this purpose the three bits of $d_B$ are applied by way of switch $RW_2$ to a correlator KO, which now compares this binary word with the age numbers contained in register $SR_2$, which are taken through the register stage $SR_{21}$ as an impulse train $s_m$. Upon agreement a coincidence signal $k_0$ results, which is taken through a gate $T_2$ in order to inhibit apparent coincidences of incorrect phase and in order to retain a coincidence impulse k which occurs at the correct time. This impulse travels through the register $SR_3$ at the slower clock rate of $e_3$ and is withdrawn at the time of the impulse $e_{05}$ through the switch $UV_k$. If now the age word stored in stages $P_{21}$, $P_{22}$, $P_{23}$ of the age register (and increased by 1 in SU) leads to coincidence, then the coincidence impulse occurs very late and at the instant of withdrawal by $e_{05}$ it will be in stage $P_{33}$ of register $SR_3$, so that the contents of the store $R_3$ are withdrawn by way of switches $UV_3$ and $u_3$. For the age words stored only in subsequent stages of $SR_2$ the respective coincidence impulses occur correspondingly earlier, so that at withdrawal they lie in stage $P_{32}$ or $P_{31}$ and effect a withdrawal of the element from $R_2$ or $R_1$.

A timing diagram for the auxiliary impulses appearing in the circuit of FIG. 17 is shown in FIG. 18. The age control in AK (FIG. 17) begins with the starting impulse $e_{011}$, which is followed by the clock pulses $e_1$ for the register $SR_1$ and for the delay stage $TV_1$. The latter clock pulse causes a new occupation pulse to be applied by way of the feedback switch RS actuated by $e_{01}$. The timings of the possible age impulses $d_k$ are shown in broken line, while the impulse $d_3$ which in fact appears is shown in solid line fashion. The duration of the binary coded age word $d_B$ is also shown. The clock pulses $e_2$ for the age register $SR_2$ and the timing pulses $e_{21}$ for the adding stage SU, suppressed by the age word $S_O$, are also shown. The times at which the age numbers $S_0$, $S_1$, $S_2$, $S_3$ circulating in the store $SR_2$ are in a position in register section $SR_{21}$ suitable for a coincidence comparison are designated by $S_0'$, $S_1'$, $S_2'$ and $S_3'$. In addition to a coincidence signal $k_0$ which does appear, further possible coincidence signals are shown in broken line fashion. From this there is derived in gate $T_2$ the shortened coincidence impulse k which is advanced in register $SR_3$ as signal $P_3 - P_2 - P_1 - P_0$. Upon the occurrence of $e_{05}$ the register $SR_3$ is called upon by the switch $UV_k$; i.e. at instant 1 (see time scale at bottom) $UV_3$ is energized by $P_3$, and at instant $2UV_1$ is energized by $P_1$. Through $UV_3$ and $UV_1$ there are provided the control signals $i_3$ and $i_1$ respectively, which, by way of the respective store switches $U_3$ and $U_1$, effect the withdrawal of the stored element and the introduction of a new element into the store.

It may be seen from FIG. 17 that the coincidence impulse k also opens a gate $T_3$ through which a three-digit null signal $g_1$ taken from a fixed value store $FS_1$ is fed in as the new contents for the interchange register $SR_{21}$. This arrangement corresponds to a simple resetting of the age number to zero, to which one age unit is then added at each circulation of the age number, i.e. after each element length has elapsed.

In the operation of the arrangement of FIG. 17 for decoding at a receiver, the switches $RW_1$ and $RW_2$ are set to position B. From the fixed value store $FS_2$ issues the three-digit binary signal which corresponds to the maximum age of 6 element lengths. This signal is fed to coincidence device KO. A coincidence impulse k now results as soon as an age signal $s_m$ reaches a limiting age. This impulse is again applied by way of the register $SR_1$, at the time of the release impulse $e_{05}$ to energize a preliminary switch $UV_k$ which effects the discharge of the respective register $R_k$ and the reception of a new element into this register. The coincidence impulse k also briefly opens a gate $T_3$, through which the new age signal associated with the new element passes. The age limit signal associated with the withdrawn element is replaced by this new age signal, which gives the age that the new element has already attained at the transmitter. After further aging at the receiver until this element reaches the age limit, a coincidence impulse then causes this element to be passed on into the decoded signal $x^*$. If the age signal $d_B$ given by the age corrector AK already corresponds to the age limit, then further aging of the received element is unnecessary. This element must therefore be forthwith passed to the output by way of the switch $U_0$. The age limit signal is determined by an age store $V_0$ responsive to the pulse sequence 110, which yields a recognition impulse $k^*$. This impulse is applied directly to the shifting register $SR_3$, so that when the new release impulse $e_{05}$ occurs it is already in the register stage $P_{30}$ and energizes the preliminary switch $UV_0$, so that store switch $U_0$ is actuated.

A comparison of this process with that of FIG. 12 shows that the requirements of the age control with a storage model or occupation register are perfectly fulfilled, and it has already been shown that compliance with these requirements suffices for fulfilling the conditions (1) and (2) for a direct coupled age corrector as shown in FIGS. 6 and 7. For this reason it is definitely ensured that, in normal operation of an arrangement in accordance with FIG. 17, elements will always be available in the delay device VE at the transmitter of which the ages correspond to the age signals $d_B$, while in the delay device $VE^*$ at the receiver a storage location will always be free when a new element is to be stored.

In the arrangement of FIG. 19 the age/location converter AP is again equipped with age register $SR_2$, adder circuit SU, coincidence circuit KO and additional register $SR_3$, similarly to FIG. 17, and the functions of these parts of the circuit likewise correspond to FIG. 17. Instead of the age control AK with its addressable register there is however provied a control system Ak that has to fulfil the conditions explained with reference to FIGS. 6 and 7 (coupled correction). For this purpose there is provided first of all a control circuit $KS_1$, the operation of which will be explained below, and an intermediate store ZS coupled with change-over switches $F_4$ and $F_5$ for interrupting and storing the preliminary age signals $a_B$ from the age preselector AV. During the operation of this arrangement the following phases may be distinguished, which may in part also be carried out in modified sequences:

Transmission (Transmit/receive change-over switches $RW_1$ and $RW_2$ in position A)

Phase 1:

Preselection of the age signal ($F_1$ in position 1). A single circulation of the age numbers $s_m$ in register $SR_2$ with simultaneous increase by one age step of the signals $s_1$, $s_2$, $s_3$. Respective clock pulses $e_2$ and adding impulses $e_{21}$ are provided by the control circuit $KS_1$.

Coincidence (k = 1):

Control signal $r_4$ from KS goes briefly to 1, so that $a_B$ is passed through switch $F_4$ into the intermediate store ZS; at the same time the control signal $r_5$ produces a changeover of switch $F_5$, so that the stored preliminary age signal $a_B$ remains available as age signal $d_B$. The circulation of $s_m$ is then completed.

Non-coincidence (k = 0):

Circulation of the age numbers $s_m$ is repeated after the preliminary age signal $a_B$ has been changed, without further increase of the age values, until a circulation with coincidence occurs.

Phase 2: Interchange of an element when the age limit is reached ($F_1$ in position 2)

A single circulatin of the age numbers $s_m$ in register $SR_2$ without increase of the age values. Appropriate clock pulses from $KS_1$.

Coincidence (k = 1):

The circulating age numbers $s_m$ correspond with the age limit signal $g_2$ provided by way of switch $F_1$ from the fixed store $FS_2$. An input pulse $r_1$ corresponding with k is applied from the control circuit $KS_1$ to the register $SR_3$, in which it is advanced from stage to stage in the direction of the arrow by the clock pulses $e_3$. In accordance with the timing of k the impulse will be situated in stage $P_{33}$, $P_{32}$ or $P_{31}$ when the auxiliary impulse $e_{05}$ appears. The preliminary store switch $UV_3$, $UV_2$ or $UV_1$ will accordingly be actuated by the impulse $P_3$ or $P_2$ or $P_1$ respectively, so that finally a store control impulse $i_3$, $i_2$ or $i_1$ effects the withdrawl of the element that has reached the age limit and the entry of a new element. From the control circuit $KS_1$ there is also provided a control impulse $r_2$ coincident with k, that opens the gate $T_3$ and effects a transfer of the zero age signal $g_1$ into the interchange register where it replaces the age signal that has increased to the age limit. The interchange is thus effected without a following Phase 3.

Non-coincidence (k = 0): Transition to Phase 3

Phase 3: Interchange of an element without reaching the limiting age ($F_1$ in position 1)

Single circulation of the age numbers $s_m$ in register $SR_2$ without increase of the age values. Appropriate clock impulse $e_2$ from $KS_1$.

On coincidence (k = 1):

The circulating age number $s_m$ corresponds with the age signal $d_B$ transferred from the store ZS. In the same manner as for a coincidence in Phase 2, the element of age $d_B$ now stored is interchanged with a newly received element and the corresponding circulating age signal is replaced by a zero age signal.

No coincidence (k = 0)

This case does not occur, since an age signal $d_B$ was already found in Phase 1, which corresponds with the stored element.

Reception (Transmit/receive change-over switches $RW_1$ and $RW_2$ in position B).

Phase 1: Preselection of the age signal ($F_1$ to position 1)

In contrast to transmission Phase 1, an age signal $d_B$ must be found that is not represented among the circulating age numbers $s_m$, in order that two elements of the same age shall not later be called up simultaneously from the delay device VE. The procedure is thus to be carried out as in Phase 1 of the transmitter operation; though the "Coincidence" and "Non-coincidence" criteria must be interchanged.

Phase 2: Interchange of an element upon reaching the age limit ($F_1$ in position 2)

A single circulation of the age numbers $s_m$ in register $SR_2$ without increase of the age values. Appropriate clock pulses $e_2$ from $KS_1$.

Coincidence (k = 1):

The circulating age number $s_m$ corresponds with the age limit signal $g_2$ supplied from the fixed stores $FS_2$ by way of switch $F_1$ (at first in position 2). A coincidence impulse k results and as in Phase 2 of the transmitter operation, a control impulse $r_1$ from the control circuit $KS_1$ coincident in time with k effects the withdrawal of an element which has reached the limiting age from the delay device VE, as well as the replacement of this element by an element of the received signal. Directly after coincidence, i.e. before the next step in the circulation of $s_m$ the gate $T_3$ is opened by the control signal $r_2$ provided from $KS_1$, so that the new age signal $d_B$ already present in the intermediate store ZS replaces the age number in interchange $SR_{21}$ which has reached the limiting value. The element interchange is thus terminated without a succeeding Phase 3.

Non-coincidence (k = 0): Transition to Phase 3

Phase 3: Transfer of an element without its reaching the age limit ($F_1$ in position 1)

An input impulse $r_1$ is provided from $KS_1$ to register $SR_3$, further clock pulses $e_3$ are also provided, through which the input pulse is transported to stage $P_{30}$. On the occurrence of the auxiliary signal $e_{05}$ the preliminary store switch $UV_0$ is actuated by the impulse $P_0$ taken from $P_{30}$, so that a control impulse $i_o$ is provided to the delay device VE, which effects the undelayed transmission of the next-received element. The circulating age number $s_m$ remains unaltered.

Since the described functions satisfy the transmitter and receiver conditions treated with reference to FIGS. 6 and 7, there again results an interchange program for the message elements corresponding for example to the graphic representation of FIG. 8, so that perfect encoding and decoding without omission or repetition or superposition of individual elements is still ensured.

In the arrangement of FIG. 19 it is from time to time tested whether the age signal $d_B$ taken as a test from the age corrector AK agrees with the age number of a stored element. If agreement is not found a repetition of the comparison with a new age signal is effected. This process thus corresponds to that used in the coupled age corrector of FIG. 6. In use at the receiver, on the other hand, an age signal is sought that does not agree with the age number of any stored element, corresponding to the coupled age corrector of FIG. 7.

Analogous results are obtained when controlling the age/location converter AP of FIG. 19 with age signals $d_B$, which are obtained by independent age correction with an arrangement as in FIG. 13, since the same criteria apply for this independent age corrector as for the coupled age correctors already mentioned.

In the arrangement of FIG. 19 with coupled age corrector, (i.e. without addressable register $SR_1$ in AK) the same results may be obtained by modification of the circuit, as in the arrangement of FIG. 17 which is operated with independent age correction as in FIG. 15. For this purpose each circulation of the age numbers in register $SR_2$ must be further repeated several times without alteration of the age numbers while simultaneously changing the age signals $d_B$ taken from AK. To develop these age signals, binary numbers are generated in AK by means of a counter, which increase by one unit after each circulation of the age numbers in $SR_2$ and are from time to time passed on to AP as age numbers $d_B$, if there appears at the same time a preliminary age impulse a' from age preselector AV, the function of which corresponds to that of the device AV' in FIG. 16. In the age corrector of FIG. 17, impulses circulating in $SR_1$ with ages advancing stepwise, from which the age signal $d_B$ is produced on the simultaneous appearance of a preliminary age impulse a' in $CW_2$. In the arrangement produced by modification from FIG. 19, on the other hand, there is provided after each preliminary age impulse a' an age signal $d_B$, which is converted into binary form through the counter already mentioned. This age signal is only effective when it corresponds with an age signal appearing in an additional circulation of $SR_2$. The operation of the register $SR_1$ of the independent age corrector (see FIG. 17) is thus replaced by repeated circulation of the age numbers in $SR_3$. The simplification produced through this coupled age correction loses its importance especially in arrangements with greater numbers of stores in the delay device VE and correspondingly high numbers of stages in the additional register.

With parallel-operated individual data stores $R_k$, as in the delay device of FIGS. 4 and 5 and also with the series connection of the store $Q_k$ of FIG. 9, there results with larger numbers of stores correspondingly numerous connections and switches. A reduction of this expense is possible, for example, with a circuit in accordance with FIG. 20, in which a first store contains the storage locations $Q_{1-4}$ for an element consisting of four bits, while a further store contains storage locatons $Q_{5-12}$ for two further elements each consisting of four bits. For storage of a larger number of elements the two stores could be further extended without additional connections. The clock signals $e_{62}$, $e_{63}$ and also the control signals $e_{60}$ and $e_{61}$ for the switches $F_{21}$ and $F_{22}$ are taken from a timer $TG_1$ to which as shown in FIG. 21 there are applied the store age-control signals $i_0$, $i_1$, $i_2$, $i_3$, as in the arrangements already described. A timing diagram of output signals dependent upon these input signals of the timer is shown in FIG. 22. It is seen that the control signal $i_0$ effects the change-over of switch $F_{21}$, so that the four bits of the next data element, coinciding with the clock pulses $e_{62}$ are passed directly from the input X to the output Y of the delay device VE. A control signal $i_1$, on the other hand, causes the actuation of switch $F_{22}$, so that the four bits are stored in the store stages $Q_{1-4}$. At the same time an element previously stored in these stages is taken by way of switch $F_{23}$ to the output. A control signal $i_2$ again first produces the generation of 8 clock pulses $e_{62}$ and $e_{63}$ in rapid succession, so that the contents of all the stores are advanced 8 steps. Thus the element initially entered in stages $Q_{5-8}$ is transferred into stages $Q_{1-4}$, and from thence is interchanged in the manner already described with a new element which is finally shifted into the stages $Q_{5-8}$ again by 4 rapid impulses in $e_{62}$. In a similar manner, an $i_3$ control impulse effects the interchange of the element entered in stages $Q_{9-12}$. The result is thus the same as in the operation of three individual stores, each with four stages.

The circuit shown in FIG. 20 certainly causes difficulties if a large number of elements which include numerous values are to be stored. In this particular case a large number of individual values must be transferred through all the store stages in the time between two individual values, or in the very brief interval between two elements, which is not technically possible in all cases. A certain relief may then be obtained by time compression of each element before storage, which results in a prolongation of the intervals. Such time compression can be effected by storing each element in an auxiliary register, from which they are withdrawn by an accelerated clock.

Special transfer of the store contents which are to be interchanged into the stages $Q_{1-4}$ may be avoided by dividing the whole data store into several stages ($Q_1$, $Q_2$ . . . in FIG. 9), the capacity of each section corresponding to an integral number of elements, additional switches ($U_1$, $U_2$, . . . in FIG. 9), each connecting two successive stages to one another when in the unactuated condition. These connections may be broken at any selected position if the respective switch is set to its actuated condition and are thus replaced by connection of one section with the output lead and connection of the following section with the input lead. Thus an element may be forthwith withdrawn at any storage section and at the same time a new element entered into the following section. The particular permutation of the control signals in RQ shown in FIG. 9 may then be omitted if the age numbers are circulated in a register similarly to the data elements, as takes place for example in register $SR_2$ in the apparatus of FIGS. 17 and 19. In this case the sections $Q_1$, $Q_2$ of the data store containing a data element and the sections $P_{21}$–$P_{23}$, $P_{24}$–$P_{26}$ of the register $SR_2$ are always mutually associated, so that upon coincidence of an age number it is immediately known at which position of the information store an element is to be interchanged; i.e. which switch of the delay device must be actuated.

The difficulties mentioned as resulting from storage with a reduced number of switches and connections are largely avoided with interdigitated storage with an arrangement as in FIG. 23, which is operated by clock pulses and control signals in accordance with the timing diagram of FIG. 24. It is here assumed that the clear signal x is a speech signal, which is divided into elements of equal length to form the data elements. Each element comprises some 200 analog sampling values, which in the analog/digital converter AD at the input of the delay device are converted into binary words of 6 bits each. Recovery of the analog signal is possible with the digital/analog converter DA at the output of the arrangement. Thus 1200 bits are required to be stored in the delay device for each element. If maximum delay times of 6 element lengths are required, then the simultaneous storage of 3 elements or 3600 bits is necessary. In the arrangement of FIG. 20 approximately this quantity of impulses 9, be transported through the register in each interval. With interdigitated storage as in FIG. 23 on the contrary a complete element length is available for this transport. The bits of the three elements are distributed in the 3600 stages of a shifting register so that the 1200 bits of the first element are placed in stages 1, 4, 7, . . . 3598, the 1200 bits of the second element in stages 2, 5, 8, . . . 3599, and the 1200 bits of the third element in stages 3, 6, 89, . . . 3600. Upon the second element being called up and for simultaneous replacement of this element by a new element, a circulation of the register contents is now effected by the clock pulses $e_{72}$, the switches $F_{25}$ and $F_{26}$ being actuated by the control signal $e_{71}$ ($i_2$) so that the bits belonging to the second element are taken to the output DA converter to obtan the sampling values of the second element. These sampling values finally form an element of the encoded signal y. At the same time the bits withdrawn are replaced by bits of a new clear signal element formed in the converter AD. The register stages of which the content has changed are shown as shaded in FIG. 23, while after the termination of the interchange, that is, when circulation is ended, arrive again in the same locations. Direct transfer of an element, without storage, on the other hand, is effected by actuation of the switch $F_{24}$ at the time determined by the timer pulse $e_{70}$ ($i_0$), while at the same time the contents of the store circulates once.

In the encoding device of FIG. 25 the condensed storage mentioned is used. For simplicity the analog/digital converter and the digital/analog converter are omitted on the assumption that the clear signals x (at the transmitter) and x* (at the receiver) are supplied and passed on respectively in digital form. The store $SR_6$ and the further stages of an adder stage SU and of an interchange register $SR_7$ connected in cascade with it together comprise 3600 stages, corresponding to 3 store portions each with 1200 bits for 200 sampling values, each coded in 6 bits, of a data element. The age signals $d_B$ are obtained for example in an age corrector AK arranged as in FIG. 17 (independent age corrector) including an addressable register, from the age trigger impulses a' of the age preselector AV and they are applied as in FIG. 17 by way of the transmit/receive changeover switches $RW_1$ and $RW_2$ to the interchange register $SR_7$ or to the coincidence circuit KO. The age register $SR_2$ shown in FIG. 7 is omitted, since the circulating age numbers are now stored with the coded data elements, for which, by omission of one sampling value of the three elements, 18 free storage locations are obtained. These free locations are situated at the front of each element, i.e. they are positioned in the interchange register $SR_6$, in the adding stage SU and in the last five stages of the shifting register $SR_7$. Even the age numbers circulating with the data elements are interdigitated. While the bits of the three data elements follow one after another in three phases, as indicated by shading in store $SR_7$, four age numbers are accommodated by likewise interdigitated bits, that is three bits associated with the element, which again are correspondingly shaded, and three unshaded bits which designate zero age for cases where storage of the element is to be dispensed with.

The control and clock signals necessary for proper operation of the arrangement are taken from a control circuit $KS_2$, which as shown in FIG. 26 responds to an applied coincidence impulse $k_2'$, for example, or to the likewise possible coincidence impulses $k_1'$, $k_3'$, $k_0'$ shown in broken line. The coincidence impulse $k_2'$ immediately effects the provision of a control signal $r_6$, that opens the gate $T_3$, so that the zero-age signal $g_1$ replaces the three bits of the age number $s_m$ in the interchange register $SR_7$. At the same time and in the same phase a control signal $e_{81}$ ($k_2'$) is initiated that appears in phase 2, the timing of the pulses being as indicated between the impules of the clock signal $e_{82}$. This control signal is in fact interrupted during the time interval $t_0$. . . $t_1$, which corresponds to the suppressed first sampling value of the three data elements and it has the effect that each of the bits corresponding to the second element is taken from the store by way of switch $F_{36}$ and is replaced by the corresponding bit of the new element to be stored by way of switch $F_{35}$. The bits of the two other elements stored during the first or third phase may be withdrawn and replaced in a similar manner. If on the other hand the age signal $d_B$ is expressed by the zero age-value 000, then an undelayed element must be passed on, which is not taken from the store but directly from the applied signal x. Upon coincidence with the circulating zero age signal $s_0$, which is indicated unshaded in the store $SR_7$, the coincidence signal $k_0'$ results which, as shown in FIG. 26, has as a consequence a periodic direct passage of the applied bits by way of switch $F_{34}$. The brief actuation of the switch suffices for the development of these input impulses, since these always have the duration between two elements of the basic clock $e_0$.

When the arrangement is installed at the receiver, the switches $RW_1$ and $RW_2$ are set to position B, i.e. a coincidence signal results in response to each agreement of a circulating age number $s_m$ with an age limit signal $g_2$ taken from $FS_2$. The bits of the element that has attained the age limit are then again, in the manner already described, replaced by the bits of an element received at that time. After coincidence has occurred the bits of the zero age signal $g_1$ are no longer applied to the interchange register $SR_7$, but the age signal $d_B$ appearing at this instant, which corresponds to the aging already carried out at the transmitter. This age signal now increased by one age step at each circulation of the receiver store. At the same time the age of the stored elements also increases until the age limit is reached, whereat a new interchange results. At the receiver an age signal $d_B$ may already represent the age limit. This signifies that the then received element has already reached the age limit at the transmitter. Such an element must not be further stored, but transferred directly to the output; i.e. a coincidence signal $k_0'$ must appear, that effects a direct signal transfer. The ciculating age signals $s_m$ therefore contain in addition to the age numbers increasing at each circulation, which are appropriate to the three stored data elements, an additional age number $s_0$ always remaining the same, that corresponds to the age limit of 6 units. Upon coincidence of this age number in KO with the limiting age $g_2$ taken from $FS_2$, likewise of 6 units, a coincidence signal k' results, which however is effective if no other coincidence impulse originating from the circulating age numbers appears. The effect of this impulse is again to result in the production of a periodically repetitive control signal $e_{80}$, that effects each time the direct transfer of the bits belonging to a newly received element by way of the switch $F_{34}$. It is thus possible also to omit the always constant age signals at the transmitter and receiver serving for direct transfer of individual elements, and to arrange the control circuit $KS_2$ so that a direct transfer is effected at any time when the three stepwise increasing circulating age numbers do not yield a coincidence, so that no data element is taken from the store.

In FIG. 26 there are also represented in time interval $t_{-1}$ to $t_0$ the clock and control signals that are included in the operation during the later sampling values, that is, during the last 6 bits of the preceding element. It is assumed that the bits appearing in phase 3 are withdrawn from the store and replaced by actuation of the switches $F_{35}$ and $F_{36}$ with the control signals $e_{81}$ ($k_3'$). There are also shown the three control impulses $e_{83}$ which increase the circulating age numbers (with the exception of the constant zero or age limit numbers) in the adding stage S0 by one unit at each circulation.

It should be noted that the suppression of one sampling value in each data element during speech encoding, which is effected in order to introduce the age numbers into the data store is without any substantial disadvantageous consequence, since this omission is not in practice noted when listening to the speech signal and brief interruptions between the elements are also introduced because of unavoidable deviations of synchronization and because in most transmission channels the transmission time is dependent upon frequency.

To avoid undesired suppression of individual portions of the data, the age numbers stored in the arrangement of FIG. 25 instead of sampling values, may be shifted into a register operating in parallel with the data store. Instead of the serial storage of, for example, six bits for each data sample value, there may be provided in all the embodiments described, parallel storage in, for example, six shifting registers with a correspondingly reduced number of stages. By the use of known techniques it is however also possible to replace the shifting registers used for storage of the elements by addressable memories known as random access memories (RAM). The construction or conversion of such circuits does not present any particular difficulties in view of the described examples and the relevant explanations.

In the examples discussed, to simplify the explanation, delay devices with only a few individual stores were provided. In practical embodiments, in order to obtain the necessary secrecy, at least a larger number of stores or a larger number of different possible ages is necessary. This is clearly possible without deviating from the principles of the described embodiments.

In FIG. 27 there is once again represented the basic principal of transmission formerly explained. The transmitting station A and also the receiving station B effect aging of the applied elements by e.g. 6 element lengths by the use of delay devices. The delay devices may be replaced by delay lines or by shifting registers with 7 tappings, the withdrawal of the signal at the transmitter and the entry of the signal at the receiver always taking place correspondingly. It is easily seen that the data elements must always pass through the same total number of delay stages, as indicated by the arrows in the drawing. Accordingly the total delay between the clear signal x at the transmitter and the reconstructed clear signal x* at the receiver is also constant (6 element lengths, for example).

However, as shown in FIG. 28, interchange of the types of station described is also possible, so that in the equivalent circuit diagram the message elements are applied at the transmitter to different tappings of the delay device B and at the receiver are withdrawn again from different tappings of the delay device A, while the interchanged elements are taken from the end of arrangement B and are applied, after transmission, to the input of arrangement A. In FIGS. 27 and 28 the arrangements are operated in accordance with the same program. There is thus no danger that an element will be suppressed or that any superposition of elements will occur, even with the transposed arrangements. On the other hand, care must be taken that a constant number (e.g. 6) of delay stages always exists between the varying tappings of B and the varying tappings of A. For this reason the control of the delay at A must always be time-displaced as compared with that at B by this constant number of element lengths. This is conveniently effected by a corresponding time-difference between the synchronizing at the transmitting and the receiving apparatus.

Thus in certain cases an apparatus arranged for encoding may be used unchanged for decoding, if the arrangements of FIG. 29 are changed over for transmitter and receiver operation. During the transmission of the clear signal $x_1$ (switches in position shown) the age signals at the two stations are developed synchronously, for transmission of the clear signal $x_2$ (switch positions reversed) a constant delay of the age signal development at the arrangement A as compared with that at arrangement B is provided. No other change-over or alteration of the type of station is necessary, however.

It may be seen from FIG. 12 that even without optimum storage utilization the number of stored elements always remains constant. With optimum utilization this number naturally cannot in any case be exceeded. It would however be possible to start an arrangement in accordance with FIG. 12 with more or less stages occupied, and it would then be found that if the conditions discussed were maintained this number of stages would likewise remain constant. It is true that a preference for particularly large or particularly small storage times would then result. If the transmitter and receiver arrangements were started with unequal numbers of stages occupied, then in an arrangement in accordance with FIG. 12 correct encoding would not be possible without special measures being taken, and naturally the same applies also to the arrangements with addressable registers shown in FIGS. 13, 15 and 17. A means for ensuring the correct number of occupied stages can be to count all the age signals d, the signals greater than the mean number being considered as positive and those less than the mean as negative. If the mean value so determined exceeds certain upper and lower limits, then correction is effected by, for example, automatically withdrawing an additional address impulse from the register or inhibiting an impules withdrawal. It is however also possible to add the age signals taken from the age corrector AK by means of a binary counter, with simultaneous subtraction of the desired mean age. Deviation of the sum towards lower values indicates incorrect store occupation and may again be made use of by automatic additional occupation or withdrawal. Such control is advantageous even in arrangement without addressable registers for producing synchronization as rapidly as possible between the transmitter and receiver stores, for example, in the arrangements of FIGS. 6, 7 and 19. Here also the signals to be additionally introduced or withdrawn may serve for correction, e.g. the injection or withdrawal of age limit signals.

APPENDIX

The quasi-randomly occurring encoding signal w can be derived from a randomly occurring control signal u which, for example, can originate with a noise voltage, the specifically timed transient values of which affect a parameter of the control signals u. The encoding signal w comprises a series of pulses which are derived in accordance with a predetermined set of rules from some parameter (e.g. pulse polarity or pulse edge timed position) of a plurality of previously generated pulses comprising control signals u.

The manner in which the encoding signal w may be derived from control signal u can be better understood with reference to FIGS. 30 and 31. A typical control signal u is illustrated in FIGS. 30*a* and 31*a* and comprises a plurality of equally spaced pulses having an equal height and either a positive or negative polarity. In the example shown, the output pulse train v (see FIGS. 30 and 31) generated by the program transformer is also composed of a series of equally spaced pulses whose polarity is determined by the polarity of several preceding control signal pulses u.

According to FIG. 30, the polarity of the pulse $v_n$ is determined by the polarity of m directly consecutive preceding pulses of pulse train u. In the particular example shown, m has been selected as being equal to 17. The 17 dominant pulses of pulse train u which determine the polarity of output pulse $v_n$ are emphasized by thick solid lines.

According to the example illustrated in FIG. 31, the polarity of each pulse v is determined by the polarities of several preceding pulses of pulse train u. However, the pulses of pulse train u which determine the polarity of the output pulse v are not in direct-consecutive sequence. Additionally, the number of pulses u which determine each pulse v need not be the same. In the example shown, the polarity of pulse $v_n$ is given by the product of the polarities of the series of 14 pulses u emphasized by thick lines in FIG. 31*b*. Similarly, the polarity of pulse $v_{n-1}$ is determined by the product of the polarities of the 13 pulses u emphasized in FIG. 31*c*. As is apparent, the number and sequence of pulses u which are used to determine the polarity of pulses $v_n$ and $v_{n+1}$, respectively, are not the same.

To ensure encoding safety, the number of pulses u which are utilized to determine the polarity of the pulse v should be sufficiently high. If the number of pulses u determining the polarity of the pulse v is m, then, e.g., with the process illustrated in FIG. 31 the largest possible variation is $2^m$ potential distributions for this group of m pulses.

To make any unauthorized decoding difficult, an attempt must be made to reduce the probability that consecutive groups of m pulses u are identical. The probability of such repeats decreases with the number of potential distributions of the pulses u. Particularly, the probability decreases exponentially with increasing values m.

FIGS. 32 through 34 illustrate block diagrams of several program transformers which may be utilized to generate the type of output pulses illustrated in FIGS. 30 and 31.

The embodiment illustrated in FIG. 32 operates according to the process illustrated in FIG. 30. The control signal u is applied to a delay line VE having a plurality of outputs $A_I$–$A_1$. The delay line VE stores a plurality of previously generated control pulses u such that such pulses can selectively be picked off by multiplier KA. The signals stored in delay line VE represent the dominant pulse group which will determine the polarity of the output pulse w. The multiplieri KA generates signals $v_1$ through $v_n$ from each applicable number of pulses selected from the group $a_1$ to $a_i$. A second circuit component ZE produces the signal w from pulses $v_1$ to $v_n$.

FIGS. 33 and 34 illustrate an embodiment of the invention which operates in accordance with FIG. 31. In this embodiment, the number of pulses u and their position within the dominant group is not constant. Accordingly, switching means are provided which are respective to the control signal u and which permutate the connections between the delay line outputs and the multiplier KA according to any predetermined program. In this case, the number of outputs can exceed that of the number of multiplier inputs.

Generally, the foregoing operation can be explained with reference to FIG. 33. The program transformer RG2 actually generates the output signal v which, after further conversion, (i.e. through ZE in FIG. 32) serves as the control signal u. The particular program which will be utilized to generate the output signal v is changed at specified times by unit RG1 which is also controlled by control signal u.

FIG. 34 illustrates a detailed example of a program transformer operating in the foregoing manner. Control signal u passes through delay line $VE_1$ of unit RG1. After passing through delay $VE_1$, control signal u is applied to the second delay line $VE_2$. Multiplier $KA_2$ generates an output signal in accordance with one of the plurality of predetermined programs stored therein. Each program will generate an output pulse in accordance with the polarity of predetermined ones of previously generated control pulses u as illustrated in FIG. 31. The particular program which is utilized by multiplier $KA_2$ is intermittently changed by a signal $s_2$ applied thereto. The signals $s_1$ and $s_2$ are produced by a multiplying unit $KA_1$ which is responsive to the outputs of first time delay circuit $VE_1$ and therefore also responsive to the control signal u. Multiplier $KA_1$ further produces a third signal $s_3$ which affects the program of memory SE such that the sequence of outgoing pulses v do not agree with the sequence of read in pulses b.

On designing the circuit components designated in FIG. 34, numerous known, technologically feasible logic circuit and electronic computer units may be utilized. Some feasibilities which can be realized by simple switching means, and whereby the output magnitudes b can be produced from only two input magnitudes $a_1$, $a_2$ is shown in FIG. 35. Particularly, this figure illustrates five possible programs A through E which may be utilized to produce the output pulses b. According to the program A, the sign of the output signal b is determined by the multiplication of the input pulses $a_1$, $a_2$. According to the program B, the sign of the output pulse b is determined by the sum of the input pulses $a_1$, $a_2$. According to the program C, an output pulse of equivalent polarity is produced only if both input pulses are of the same polarity. According to program D, the output pulse b has the sign of the sum of the input pulses, however, if the sum is 0, than the output magnitude retains the level which it occupied at the immediately preceding pulse time. Finally, according to program E, the magnitude of the output signal b is changed only when the polarity of both input signals are identical. With all of the combinations, the output of both polarities remain at the same level as the previous pulse time.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. A method for coded transmission of data comprising the steps of:

(A) at a transmitting station including first and second memories each having a plurality of storage locations;

(1) dividing a signal to be transmitted into a succession of discrete message elements of equal length;

(2) generating a first set of age signals in a random fashion wherein each of said age signals are chosen from the real integers n = 0, 1, 2, 3, . . . , N, one of said age signals being generated during each of a plurlity of successive time periods;

(3) storing a different one of said message elements in said first memory each time a new random age signal is generated, the memory location into which a message elememt is stored during any given time period being determined by the value of the random age signal generated during said given time period;

(4) assigning a predetermined age number to each said message element as said message element is placed in storage and storing said assigned age numbers in a second memory, said predetermined age number being integer and indicating that the message element to which it has been assigned has just been placed in storage;

(5) altering the value of each of said stored age numbers by one integer during each of said successive time periods whereby the instantaneous value of each of said stored age numbers indicates the number of said time periods its respective message element has been in storage, (6) comparing said stored age numbers with said random age signals and transmitting a different one of said stored message elements during each of said time periods, the message element transmitted during any given time period being that message element whose corresponding age number is equal to the random age signal generated during said given time period;

(7) said step of storing said message elements in a storage location determined by the value of the random age signal generated during any given time period comprising the step of storing the next occurring discrete message element in the storage location of said first memory previously occupied by the message element most recently transmitted;

(B) at a receiving station including third and fourth memories each having a plurality of memory locations;

(1) generating a second set of random age signals at said receiver, said second set of random age numbers being identical in sequence and frequency to said first set of random age numbers;

(2) receiving said transmitted message element in the same sequence in which they are transmitted;

(3) storing each of said received message elements in said third memory in the order in which said message elements are received;

(4) assigning an age number to each message element as it is stored in said third memory, the age number assigned to a message element stored in said third memory during any given time period being equal to the value of the random age signal generated during said given time period whereby the age number initially assigned to each message element stored in said third memory indicates the number of time periods said message element was stored at said transmitter;

(5) storing said assigned age numbers in said fourth memory;

(6) alternating each of said age numbers stored in said fourth memory by one integer in the same sense as the age numbers stored in said second memory are being altered such that the instantaneous value of each of said age numbers stored in said fourth memory is indicative of the total amount of time its corresponding message element has been in storage; and (7) reading the message element whose corresponding age number reaches a predetermined value out of said third memory such that the message elements are read out of said third memory in the same order as they are read into said first memory.

2. The method of claim 1 wherein said predetermined age number is 0 and wherein said steps of altering the value of said age numbers stored in said second and fourth memories, respectively, each comprise the step of increasing the value of each of said stored age numbers by one integer during each of said time periods.

3. The method of claim 1 wherein said predetermined age number is a predetermined maxmimum value and wherein said steps of alterning the value of said age numbers stored in said second and fourth memories, respectively, each comprise the step of decreasing the value of each of said stored age numbers by one integer during each of said time periods.

4. The method of claim 1 further comprising the step of preventing the generation of random age signals at said transmitter that do not correspond with the instantaneous value of any of said age numbers stored in said second memory.

5. The method of claim 4 wherein said step of preventing the generation of random age signals comprises the steps of generating preliminary random age signals, comparing each of said preliminary age signals with said age numbers stored in said second memory and forcing a change in the preliminary age signal just generated before the occurrence of the next succeeding time interval such that a permissible said age signal is generated during each of said time periods.

6. The method of claim 1 further comprising the step of preventing the generation of a random age signals at the receiver which corresponds to any of the age numbers stored in said fourth memory.

7. The method of claim 6 wherein said step of preventing the generation of age signals comprises the step of generating a preliminary age signal, comparing said preliminary age signal with said age numbers stored in said fourth memory and forcing a change in said preliminary age signal so as to generate a permissible age signal prior to the initiation of the next succeeding time period whereby a permissible age signal is generated during each of said time periods.

8. The method of claim 1 wherein said first and second sets of age numbers are equal at all times.

9. The method of claim 1 wherein when the value of any of said age numbers stored in said second memory correspond to said pre-determined maximum value in any given time period, the message element transmitted during said given time period is the stored message element whose corresponding stored age number has reached said maximum value.

10. A method in accordance with claim 1 wherein, in order to avoid superposition or omission of elements in the encoded information, age signals of which the time separation corresponds with their difference in value are avoided.

11. A method in accordance with claim 10, wherein the generation of different age signals is repeated during each time period until an age signal appears of which the difference in value from any preceding age signal does not correspond with its time difference from that signal.

12. A method in accordance with claim 10 wherein, succeeding age signals are compared so that if the difference in value of an age signal as compared with a preceding age signal corresponds with its difference in timing from that signal, the value of the last generated signal is altered by a predetermined amount, so that the difference in value no longer corresponds with their time differences.

13. A method in accordance with claim 2, wherein, at a received station where the withdrawal from store of a message element results each time after correspondence of its age number with a second extreme value, omission of individual message elements during a message element interval is avoided by directly transmitting a newly received message element when no age number allotted to a stored message element has attained the second extreme value.

14. Apparatus for the encoded transmission of data comprising a plurality of discrete message elements of equal length, said apparatus comprising:

(A) a message element receiving input and an output;

(B) age generator means for generating age signals in a random fashion wherein said age signals are chosen from the integers 0, 1, 2, 3, . . . , N, one said age signal being generated during each of a pluralty of message intervals;

(C) first memory means for storing said message elements, a different message element being placed in said first memory means during each of said message intervals;

(D) age/location converting means including:

(1) means for assigning a predetermined age number to each of said message elements as they are placed in said first memory means, said predetermined age number being an integer and indicating that its corresponding message element has just been placed in storage, said means for assigning a predetermined age number including second memory means for storing said assigned age numbers;

(2) means for altering the value of each of said stored age numbers by one integer during each of said successive message intervals whereby the instantaneous value of said stored age numbers indicates the number of said message intervals its respective message element has been in storage;

(3) means for comparing said stored age numbers with said random age signals; and (4) means for removing a different one of said stored message elements from said first memory means and applying said removed message element to said output during each of said message intervals, the message element removed during any given message interval being that message element whose corresponding stored age number is equal to the random age signal generated during said given time interval.

15. Apparatus in accordance with claim 14, wherein the age generator means comprises a pulse generator for obtaining a train of quasi-randomly varying store-control impulses and a corrector circuit for deriving from this impulse train said random age signals.

16. Apparatus in accordance with claim 15, wherein the age/location converter means contains an OR gate and additional coincidence circuits to each of which is applied a signal representing the state of count of the counter and the age signal and wherein the output signals of the coincidence circuits are coupled to said OR gate for applying a new age signal request to said generator means, so that a new age signal becomes available when an age signal already provided corresponds with the state of count of an age counter.

17. Apparatus in accordance with claim 15, including gate means and first switch means wherein the individual store-control impulses are applied to said gate means for generating an output impulse if no control impulse appears and wherein the output impulse is applied as a control impulse to said further switch means which directly couples an input signal to said output.

18. Apparatus in accordance with claim 15, further comprising a shift register to develop the age signals whereby a new impulse is applied at time intervals of one element length, a control circuit including a gate and being coupled to each of the stages, each control circuit coupled to an adjacent control circuit and having control inputs respectively coupled to an associated stage of said register and to said generator means and being arranged to respond to coincidence between the following signals:

a control impulse from the preceding control circuit which is connected with the subsequent register stage;

an impulse from the respective register stage; a preliminary age impulse from the age preselector (this latter signal being unnecessary for coincidence in the case of the first and the last coincidence circuit);

and wherein upon response of a control circuit the associated gate is actuated to withdraw an impulse from the respective register stage and if the control circuit does not respond a control impulse is provided to the next subsequent control circuit.

19. Apparatus in accordance with claim 15, further comprising plural control circuits each including a gate, and a multi-stage shifting register to which a new impulse is applied at time intervals of one element length and each of the stages of which is connected with one of said control circuits, each control circuit having control inputs arranged to respond to coincidence between the following signals:

a control impulse from the preceding control circuit which is connected with the subsequent shifting register stage;

an impulse from the respective shifting register stage;

a preliminary age impulse from the age preselector;

and wherein upon response of a control circuit the associated gate is actuated for withdrawal of an impulse from the respective shifting register stage and if the control circuit does not respond a control impulse is provided to the next subsequent control circuit, while if the last control circuit, which is connected to the first shifting register stage, does not respond a control impulse is provided to the first control circuit, which is connected with the last register stage and a new preliminary age impulse is provided by the age generator means.

20. Apparatus in accordance with claim 15, wherein there is provided a shifting register to obtain the age signals, a feedback switch coupled between the input output stages of said register into which new input impulses are introduced by way of said feedback switch at time intervals of one element length, and the contents of which are fed back from the output to the input at an increased clock rate between two such introductions by way of the feedback switch, a control circuit coupled to the last stage of this shifting register and having a gate and control inputs arranged to respond to coincidence between the following respective signals:

a control impulse generator for generating a control impulse, that corresponds to the starting impulse initiating the control operation or to a preceding control impulse taken from the control circuit and delayed in a delay stage coupled between the input and output of the control circuit;

an impulse from the last register stage; a preliminary age impulse from the age generator means (always present in controlling the first and the last stage of the register);

and wherein upon response of the control circuit said gate is actuated for withdrawing the impulses appearing in the last register stage and when the control circuit is not actuated a control impulse is fed back by way of said delay stage to the control circuit.

21. Apparatus in accordance with claim 15, wherein there is further used to obtain the age signals an accelerated clock means and an n-stage shifting register and a feedback switch coupled between the input and output stages of the register into which new input signals are introduced by way of said feedback switch at time intervals of one element length, and the contents of which are fed back from the output to the input at an increased clock rate controlled by the accelerated clock means between two successive input impulses by way of the feedback switch, the last stage of the register being connected with a control circuit which includes a gate and having control inputs enabling the control circuit to respond to coincidence of the following signals:

a control impulse developed by a control impulse generator, which impulse corresponding to a starting impulse initiating the control operation or to a preceding control impulse taken from the control circuit and delayed in a delay stage coupled between the input and output of the control circuit;

an impulse from the last stage of the register;

a preliminary age impulse from the age generator means;

and wherein upon response of the control circuit said gate is actuated to withdraw impulses from the last stage of the register and if the control circuit does not respond a control impulse is fed back over the delay stage to the input of the control circuit, while if the control circuit has not responded after n steps of the accelerated clock means, wherein n is equal to the number of stages in the shifting register, the control operation is repeated with a changed preliminary age impulse.

22. Apparatus in accordance with claim 15, wherein the age/location converter means comprises a multi-stage shifting register for storing a plurality of binary numbers (the age numbers) each of which is associated with a message element stored in the first storage means and clock means for advancing said numbers in the register at a clock rate higher than the message element repetition frequency, a control section having a plurality of storage stages forming a part of said register, said stages containing one binary number, a coincidence circuit coupled to said generator means and said storage stages for yielding a coincidence impulse upon correspondence between this binary number and a reference number, and adding circuit means for coupling the output of the shifting register with its input for changing the binary number by one unit each time the number passes therethrough.

23. Apparatus in accordance with claim 22, including a first changeover switch, a gate circuit coupling the storage stages of the register control section to said first change-over switch, by way of which a new binary number may be introduced into these stages, a second change-over switch, said coincidence circuit being connected with said second change-over switch, by way of which the bits of the reference number from said generator means are introduced.

24. Apparatus in accordance with claim 23, wherein there is passed through the first change-over switch a first extreme number and through the second change-over switch the age signal taken from the generator means when the apparatus is is employed at a transmitter facility, and that there is passed through the first change-over switch the age signal taken from the generator means and through the second change-over switch a second extreme number when the apparatus is employed at a receiver facility.

25. Apparatus in accordance with claim 22, including a control circuit and a change-over switch, wherein the coincidence circuit is connected with said control circuit which, after the application thereto of a coincidence impulse, yields a control impulse for actuating said change-over switch, for causing the message element, to which the age number leading to coincidence is appropriate, is withdrawn from the first storage means.

26. Apparatus in accordance with claim 25, wherein the control circuit consists of a second shifting register for receiving an impulse upon said coincidence circuit, intermediate switch means for coupling the stages thereof, which store the individual store control impulses, to the switch means by way of which the elements are passed on from the individual storage locations.

27. Apparatus in accordance with claim 22, wherein the age corrector further includes a counter for obtaining binary numbers, a clock for changing the binary numbers by one unit at a predetermined basic clock rate to be passed on to the age/location converter means as age signals, when a preliminary age impulse from the age preselector appears at the same time, wherein in the age register of the age/location converter means the age numbers are circulated unchanged each time during several changes of the binary numbers and wherein a coincidence impulse is provided upon the appearance of coincidence between a circulating age number and a reference signal corresponding with the age signal.

28. Apparatus in accordance with claim 22, wherein when the apparatus is used as a transmitter facility, the age corrector is supplemented by a control circuit to which the coincidence impulse is applied, wherein the control circuit effects the application of a new age signal to the age/location converter means when the age signal first provided does not correspond with any of the age numbers circulating in the age register and wherein when the apparatus is used at the receiver facility, the control circuit effects the application of a new age signal to the age/location converter when the age signal first provided does correspond with one of the age numbers circulating in the age register.

29. Apparatus in accordance with claim 22, wherein the age/location converter means contains a coincidence circuit, which upon correspondence of an age number with a reference number yields a coincidence impulse, a timer and control circuit means responsive to this impulse for controlling the timer so that only the bits belonging to the message element to be interchanged are withdrawn from the first storage means and are replaced by the bits of the new message element.

30. Apparatus in accordance with claim 22, wherein the first storage means and the shifting register are combined in a common register, in the stages of which are stored data elements derived from speech signals, with the exception of the bits representing the last sampling value of each element, instead of which there are present in immediate succession the bits representing the age number associated with the element, and a control circuit responsive to said coincidence impulse developing the control signals for the introduction into and withdrawal from the first storage means of the bits of individual elements and for the direct undelayed transmission of individual elements.

31. Apparatus in accordance with claim 14, wherein the age/location converter means contains at least one binary type counter device, by means of which the binary numbers representing the age signals associated with the stored message elements are changed by one unit at intervals of one element length, and also contains switching means which yield a coincidence impulse upon correspondence of the age number attained with the age signal.

32. Apparatus in accordance with claim 31, wherein the age/location converter means contains a plurality of counters which are advanced by equidistant clock pulses, plural coincidence circuits, each counter being associated with one of said coincidence circuit which yields an output impulse upon correspondence of the age number (counter state) with the age signal provided by the age generator and the count in its associated counter, said switch means comprising change-over switch means associated with each first storage means for selectively coupling its associated storage means to said input and said output; said output impulse on the one hand controlling the reset impulse for the counter, which is thus brought to its initial condition, and on the other hand forms a store-control impulse used to control the change-over switch means of the associated first storage means, so that an element, of which the storage time corresponds to the age signal then present, is withdrawn from the store connected with the switch means and is replaced by a new element.

33. Apparatus in accordance with claim 32, wherein each counter in the age/location converter means yields an age limit impulse when the counter condition attains a definite extreme value, wherein these age limit impulses are applied on the one hand, as are the output impulses of the respective coincidence circuit, as resetting impulses to the counter itself and on the other hand are applied to the first storage means as store control impulses, repeat control gate means for receiving all of said age limit impulses which, in the absence of all of said input impulses yields a repetition impulses applied to said age generator means to cause repeated generation of age signals until an input impulse is applied to said repeat control gate means.

34. Apparatus in accordance with claim 32, wherein each counter in the age/location converter yields an age limit impulse when the age number (counter condition) attains a definite limiting value, and an OR gate wherein the age limit impulses of all the counters are applied to said OR gate which in the presence of any input signal yields a control signal, a second gate coupled between said generator and said coincidence circuits and controlled by said control signal whereby said gate is opened to pass an age signal when any one of said counters has reached the age limit number.

35. Apparatus is accordance with claim 31, wherein the age/location converter means contains a switching means which yields a control impulse when the age signal corresponds to 0(zero) storage time, said switch means including a switch for coupling said input and said output to said first storage means and the control impulse actuates said switch means by way of which the input signal applied to the first storage means delay device is transmitted directly to its output.

36. Apparatus in accordance with claim 14, wherein the age/location converter means contains at least one counter device, by means of which the binary numbers associated with the stored elements are changed by one unit at intervals of one element length, and also contains switching means which provide an impulse upon correspondence of the age number attained with an extreme age number.

37. Apparatus in accordance with claim 36, wherein the age/location converter means contains further switching means which yields a control impulse when the age signal corresponds to zero storage time and a further coupling switch wherein the control impulse actuates said coupling switch for directly coupling said input to said output.

38. Appartus in accordance with claim 14, wherein the age/location converter means contains a plurality of counters which are simultaneously advanced by equidistant clock pulses and yield a control impulse as soon as the age number (counter condition) attains a final predetermined value, said switch means comprising change-over switch means for coupling each storage location of said first storage means to said input and said output, and a gate circuit associated with each counter wherein the control impulse on the one hand actuates a gate circuit through which the age signal is applied to its associated counter to bring this counter into the condition corresponding to the value of the age signal, and on the other hand forms a store-control impulse that actuates a change-over switch means of the first storage means so than an element is taken from the storage location connected with the switch and is replaced by a new element.

39. Apparatus in accordance with claim 14, wherein the first storage means consists of a plurality of individual stores, change-over switches provided between adjacent stores each of said stores containing one data element and the output of each of which is connected with its own input by way of a respective change-over switch in the unsaturated position, while upon actuation of a said change-over switch the output of a store is connected to said output and the input of a succeeding store is connected with said input.

40. Apparatus in accordance with claim 14, wherein the first storage means consists of a plurality of random access memories, each of which contains the bits of one element and are connected through switches by means of which these bits may be selectively applied to and withdrawn from the memories.

41. Apparatus in accordance with claim 14, wherein the first storage means consists of a plurality of individual stores, connecting switch means, said stores being connected through said connecting switch means which in the unactuated condition, connect the output of a store with the input of the subsequent store and in the actuated condition connect the output of a store with said output lead and the input of the subsequent store with said input.

42. Apparatus in accordance with claim 41 comprising an age register, wherein each connecting switch of the first storage means is associated with a section of the age register containing an age number, in which there circulates age numbers changing stepwise by one unit, coincidence means for actuating a connecting switch when the age number contained in the associated age register section coincides with a reference signal from the generating means.

43. Apparatus in accordance with claim 14, wherein the first storage means consists of at least one shifting register, in the stages of which the bits of the data elements are distributed in such a manner that following the first bits of each element there occur the second bits of each element, and so on, a timer and means responsive to said timer for successively withdrawing or introducing only those bits associated with a particular message element.

44. A system in accordance with claim 14, including two coding of said apparatus coupled through a transmission path, wherein switches couple both the input lead and the output lead of the apparatus through which selectively the clear signal is applied for encoding and at the same time the encoded signal is withdrawn for transmission, or the received encoded signal is applied for decoding and at the same time the decoded signal is withdrawn, wherein for transmission in one direction the age signals of the two apparatus correspond in time and for transmission in the other direction there is a fixed time difference between the age signals of the two apparatuses, which corresponds to the total delay time which each data element undergoes in passing through the stores of the two apparatus.

45. The apparatus of claim 14 further including means for directly coupling a message element applied to said message receiving input to said output, and thereby bypassing said first memory means, whenever said random age signal is 0.

46. The apparatus of claim 14 wherein said second memory means comprises a plurality of binary counters equal in number to the maximum number of assigned age numbers which may be stored in said second memory means, the instantaneous count of each of said binary counters being indicative of the number of said message intervals its respective message element has been in storage.

47. The apparatus of claim 46 wherein said comparing means comprises a plurality of coincident circuits equal in number to the number of said binary counters, each of said coincident circuits associated with a different one of said counters, each of said coincident circuits for generating an impulse signal when the count in its corresponding binary counter is equal to the instantaneous value of said random age signal.

48. The apparatus of claim 46 wherein said comparing means compares the instantaneous value of said random age signals with the instantaneous count in said counters and generates an impulse identifying the binary counter whose count is equal to said instantaneous age signal.

49. The apparatus of claim 48 further including threshold means for generating an impulse signal whenever the count in one of said counters reaches a predetermined maximum value, said impulse signal identifying the counter whose count has reached said maximum value.

50. The apparatus of claim 49 wherein said means for removing stored message elements from said first memory means comprises switch means responsive to said impulses generated by said comparing means and said threshold means for removing in any given message interval the stored message element identified by the impulse signal generated in that message element and for replacing the removed message element with an unstored message element applied to said element receiving input.

51. The apparatus of claim 49 wherein said threshold means includes circuitry within each of said binary counters which generate an impulse signal whenever the count in the counter reaches a predetermined maximum value.

52. The apparatus of claim 51 wherein the impulse generated by any one of said counters serves to reset the count in said counter.

53. The apparatus of claim 52 further including means for inhibiting the generation of said random age signal in any message interval during which one of said counters generates an impulse signal.

54. The apparatus of claim 53 wherein said mean for inhibiting the generation of an age signal comprises an OR gate which generates an output signal whenever any one of said counter generates an impulse signal and a gating means responsive to said output signal for passing said age signals only when said output signal is not generated by said OR gate.

* * * * *